US006376759B1

(12) United States Patent
Suzuki

(10) Patent No.: US 6,376,759 B1
(45) Date of Patent: Apr. 23, 2002

(54) ELECTRONIC KEYBOARD INSTRUMENT

(75) Inventor: Satoshi Suzuki, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 09/532,127

(22) Filed: Mar. 21, 2000

(30) Foreign Application Priority Data

Mar. 24, 1999 (JP) ..... 11-078882

(51) Int. Cl.[7] ..... G10H 1/18; G10H 7/00

(52) U.S. Cl. ..... 84/615; 84/626; 84/628; 84/629

(58) Field of Search ..... 84/615, 626, 628, 84/629, 633, 653, 698, 662, 746

(56) References Cited

U.S. PATENT DOCUMENTS 5,081,898 A * 1/1992 Fujimori ..... 84/626 X
5,142,960 A * 9/1992 Iwasa et al. ..... 84/662
5,216,189 A * 6/1993 Kato ..... 84/662
5,241,126 A * 8/1993 Usa et al. ..... 84/615
5,241,130 A * 8/1993 Shibukawa ..... 84/659
5,292,995 A * 3/1994 Usa ..... 84/626
5,541,356 A * 7/1996 Usa ..... 84/626
5,619,005 A * 4/1997 Shibukawa et al. ..... 84/658

FOREIGN PATENT DOCUMENTS

JP 2-146596 6/1990
JP 3-116096 5/1991

* cited by examiner

*Primary Examiner*—Jeffrey Donels
(74) *Attorney, Agent, or Firm*—Morrison & Foerster LLP

(57) ABSTRACT

An electronic keyboard instrument is basically configured by a keyboard, a microcomputer, a tone generator and a sound system as well as sensors, switches and foot switches. Each of keys of the keyboard is equipped with a variety of sensors and switches such as a touch sensor, make switches, a key-stroke sensor, key-depression pressure sensors and a hammer-depression pressure sensor, while the foot switches correspond to a damper pedal, a soft pedal and a sostenuto pedal as well as a slur foot switch and a portamento foot switch. Herein, various acoustic instruments are related to different performance techniques respectively. So, operating a foot switch designate a specific performance technique detection rule in response to a desired tone color corresponding to an acoustic instrument whose sounds are being simulated. Then, a performance technique is detected in accordance with the performance technique detection rule on the basis of outputs of the sensors, at least one of which is selectively used. Thus, the tone generator generates musical tones with respect to the tone color, wherein the musical tones are controlled in response to the performance technique with respect to at least one tone factor (e.g., a tone volume, tone color and pitch). Incidentally, operating the slur foot switch designate a slur-related performance technique detection rule for detection of performance techniques such as slur and staccato. In addition, operating the portamento foot switch designate a portamento-related performance technique detection rule for detection of performance techniques such as portamento and glissando.

38 Claims, 13 Drawing Sheets

| ACOUSTIC INSTRUMENTS | MUSICAL EXPRESSIONS | SENSORS AND SWITCHES OF KEYBOARD: TOUCH | TOUCH→M1 | VELOCITY ON | KEY STROKE | HAMMER PRESSURE | KEY PRESSURE | DEPRESSION | LEFT/RIGHT KEY | VELOCITY OFF | CONTROLS FOR ACTUALIZATION OF PERFORMANCE TECHNIQUES ON KEYBOARD | CONTROL FACTORS IN MUSICAL EXPRESSIONS |
|---|---|---|---|---|---|---|---|---|---|---|---|---|
| COMMON PERFORMANCE TECHNIQUES | TENUTO | | | | ○ | ○ | ○ | | | | EG CONTROL WITH KEY STROKE, TONE VOLUME (DECAY: HAMMER PRESSURE, SUSTAIN: KEY PRESSURE) | |
| | MARCATO | | | | ○ | ○ | ○ | | | | SAME ABOVE | EG |
| | STACCATO | ○ | | | ○ | | | | | | KEY OFF BY TOUCH OFF | EG |
| | SLUR | | | | ○ | | | | | | SUCCEED EG OF PRECEDING KEY BY SLUR PEDAL | EG |
| | LEGATO | | | | ○ | ○ | ○ | | | | SUSTAIN KEY ON FURTHER LONGER THAN TENUTO | EG |
| | PORTAMENTO | ○ | | | | | | | | | TOUCH TARGET SURFACE OF KEY AFTER KEY-ON | CONTINUOUS VARIATIONS OF PITCHES ONLY |
| | GLISSANDO | ○ | | | | | | | | | SAME ABOVE | SEQUENTIAL VARIATIONS OF PITCHES ONLY |
| | VIBRATO | | | | | | | ○ | | | VARIATIONS IN LEFT/RIGHT PRESSURES AFTER KEY ON | PITCH |
| | TREMOLO | | | | | | ○ | | | | DEPRESSION OF KEY | ACCENT, REITERATION OF SAME NOTE |
| | KOBUSI (OR REITERATION) | ○ | | | | | | | | | SMALL VARIATIONS IN PORTAMENTO | CONTINUOUS VARIATIONS OF PITCHES |
| | CRESCENDO | | | | | | ○ | | | | CHANGE TONE VOLUME BY KEY DEPRESSION | TONE VOLUME CONTROL |
| | DECRESCENDO | | | | ○ | | ○ | | | | REVERSE TO CRESCENDO | TONE VOLUME CONTROL |
| | TONE COLOR VARIATIONS | | | | | | ○ | | | | FILTER CONTROL BY KEY DEPRESSION | FILTER, EFF CONTROLS |
| | REVERBERATION | | | | ○ | | | | | ○ | CONTROL RELEASE RATE BY KEY-OFF VELOCITY | RR |
| | RAPID PERFORMANCE IN PPP | | | | ○ | | | | | | TONE-GENERATION CONTROL BY STROKE POSITION | TONE VOLUME, TONE COLOR CONTROLS |

| ACOUSTIC INSTRUMENTS | MUSICAL EXPRESSIONS | MUSICAL FACTORS | | | | | MUSICAL EFFECTS |
|---|---|---|---|---|---|---|---|
| | | POSITION | ATTACK | SUSTAIN | DECAY | SMOOTH | |
| COMMON PERFORMANCE TECHNIQUES | TENUTO | ○ | ○ | ○ | ○ | ○ | SUFFICIENTLY SUSTAIN TONE VOLUME FOR EACH NOTE |
| | MARCATO | | ○ | ○ | ○ | ○ | CLARIFY EACH NOTE ONE-BY-ONE |
| | STACCATO | | ○ | ○ | ○ | ○ | PLAY EACH NOTE CLEARLY AND SEPARATELY |
| | SLUR | | ○ | ○ | ○ | ○ | PLAY NOTES CONTINUOUSLY |
| | LEGATO | | ○ | ○ | ○ | ○ | PLAY NOTES SMOOTHLY AND CONTINUOUSLY |
| | PORTAMENTO | | ○ | ○ | ○ | ○ | SMOOTH TRANSITION OF PITCHES FROM ONE NOTE TO ANOTHER |
| | GLISSANDO | | ○ | ○ | ○ | ○ | PLAY NOTES FROM ONE TO ANOTHER SLIDINGLY |
| | VIBRATO | | | ○ | | | SMALL VARIATIONS OF PITCHES |
| | TREMOLO | | | ○ | | | RAPID REITERATION OF A SINGLE NOTE |
| | KOBUSI (OR REITERATION) | | | ○ | | ○ | INCREASE AND DECREASE PITCHES IMPROMPTU TO PRODUCE FINE GRACE NOTES |
| | CRESCENDO | | | ○ | | ○ | PLAY NOTES TO GRADUALLY GET LOUDER |
| | DECRESCENDO | | | ○ | | ○ | PLAY NOTES TO GRADUALLY GET SOFTER (DIMINUENDO) |
| | TONE COLOR VARIATIONS | ○ | ○ | ○ | | | CHANGE TONE COLORS WHILE SUSTAINING NOTES |
| | REVERBERATION | | | | ○ | | MUTE (OR DIMINISH) IN PLAYING NOTES |
| | RAPID PERFORMANCE IN PPP | | ○ | | ○ | ○ | RAPID AND VERY SOFT PERFORMANCE OF NOTES |

FIG.6

| ACOUSTIC INSTRUMENTS | MUSICAL EXPRESSIONS | MUSICAL FACTORS | | | | | MUSICAL EFFECTS |
|---|---|---|---|---|---|---|---|
| | | POSITION | ATTACK | SUSTAIN | DECAY | SMOOTH | |
| BOWED STRINGED INSTRUMENTS | DETACHE | ○ | ○ | | ○ | | USING A BOW |
| *VIOLIN | SPICCATO | ○ | ○ | | ○ | | SHORT PERFORMANCE CONDUCTED WITH A CENTER PORTION OF A BOW AT A RAPID TEMPO |
| *VIOLA | PIZZICATO | ○ | ○ | | ○ | | PLAYING A STRING WITH A FINGER |
| *CELLO | CORRENTE | ○ | ○ | | | | TAPPING A STRING WITH A WOOD PORTON OF A BOW |
| *CONTRABASS | | | | | | | |
| REED INSTRUMENTS | TONGUING | | ○ | ○ | ○ | ○ | CONTROL VIBRATIONS OF A REED WITH TONGUE |
| *SAXOPHONE | GROWL | ○ | ○ | ○ | | | PRODUCE VOICE SIMULTANEOUSLY WITH BLOWING |
| *CLARINET | TIGHTENING LIPS | ○ | ○ | ○ | | ○ | CHANGE TONE COLOR AND PITCH |
| *OBOE | HOLD REED IN MOUTH | ○ | | ○ | | | CHANGE TONE COLOR |
| *ENGLISH HORN | BLOWING INTENSITY | | ○ | ○ | ○ | ○ | CHANGE TONE VOLUME AND TONE COLOR |
| HORN | | | | | | | |
| *BASSOON | | | | | | | |
| BRASS INSTRUMENTS | TONGUING | | ○ | | ○ | ○ | CONTROL AIR FLOW BY MOVEMENT OF TONGUE |
| *CORNET | FLUTTER | ○ | ○ | ○ | | | ROLLING TONGUE BEING SOFTLY TOUCHED WITH (UPPER) LIP |
| *TRUMPET | TIGHTENING LIPS | ○ | ○ | ○ | ○ | ○ | CONTROL OVERTONES BY TIGHTENING LIPS |
| *TROMBONE | ANGLE OF LIPS | ○ | ○ | ○ | | | CONTROL OVERTONES BY ANGLE OF LIPS |
| *HORN | SHAKE, TRILL | | | ○ | | | PRODUCE OVERTONES BY CHANGING BLOWING INTENSITY |
| *TUBA | | | | | | | |
| KEYBOARD INSTRUMENT | ITCHY-DAMPER | | | | ○ | | DAMPER EFFECT REMAINS ON SPECIFIC KEY |
| *PIANO | | | | | | | |

FIG.7

| ACOUSTIC INSTRUMENTS | MUSICAL EXPRESSIONS | SENSORS AND SWITCHES OF KEYBOARD | | | | | | | | CONTROLS FOR ACTUALIZATION OF PERFORMANCE TECHNIQUES ON KEYBOARD | CONTROL FACTORS IN MUSICAL EXPRESSIONS |
|---|---|---|---|---|---|---|---|---|---|---|---|
| | | TOUCH | TOUCH→M1 | VELOCITY ON | KEY STROKE | HAMMER PRESSURE | KEY PRESSURE | LEFT/RIGHT KEY DEPRESSION | VELOCITY OFF | | |
| COMMON PERFORMANCE TECHNIQUES | TENUTO | | | | ○ | ○ | ○ | | | EG CONTROL WITH KEY STROKE, TONE VOLUME (DECAY: HAMMER PRESSURE, SUSTAIN: KEY PRESSURE) | |
| | MARCATO | | | | ○ | ○ | ○ | | | SAME ABOVE | EG |
| | STACCATO | ○ | | | ○ | | | | | KEY OFF BY TOUCH OFF | EG |
| | SLUR | | | | ○ | | | | | SUCCEED EG OF PRECEDING KEY BY SLUR PEDAL | EG |
| | LEGATO | | | | ○ | ○ | ○ | | | SUSTAIN KEY ON FURTHER LONGER THAN TENUTO | EG |
| | PORTAMENTO | ○ | | | | | | | | TOUCH TARGET SURFACE OF KEY AFTER KEY-ON | CONTINUOUS VARIATIONS OF PITCHES ONLY |
| | GLISSANDO | ○ | | | | | | | | SAME ABOVE | SEQUENTIAL VARIATIONS OF PITCHES ONLY |
| | VIBRATO | | | | | | | ○ | | VARIATIONS IN LEFT/RIGHT PRESSURES AFTER KEY ON | PITCH |
| | TREMOLO | | | | | | ○ | | | DEPRESSION OF KEY | ACCENT, REITERATION OF SAME NOTE |
| | KOBUSI (OR REITERATION) | ○ | | | | | | | | SMALL VARIATIONS IN PORTAMENTO | CONTINUOUS VARIATIONS OF PITCHES |
| | CRESCENDO | | | | | | ○ | | | CHANGE TONE VOLUME BY KEY DEPRESSION | TONE VOLUME CONTROL |
| | DECRESCENDO | | | | ○ | | ○ | | | REVERSE TO CRESCENDO | TONE VOLUME CONTROL |
| | TONE COLOR VARIATIONS | | | | | | ○ | | | FILTER CONTROL BY KEY DEPRESSION | FILTER, EFF CONTROLS |
| | REVERBERATION | | | | ○ | | | | ○ | CONTROL RELEASE RATE BY KEY-OFF VELOCITY | RR |
| | RAPID PERFORMANCE IN PPP | | | | ○ | | | | | TONE-GENERATION CONTROL BY STROKE POSITION | TONE VOLUME, TONE COLOR CONTROLS |

FIG.8

| ACOUSTIC INSTRUMENTS | MUSICAL EXPRESSIONS | SENSORS AND SWITCHES OF KEYBOARD | | | | | | | | CONTROLS FOR ACTUALIZATION OF PERFORMANCE TECHNIQUES ON KEYBOARD | CONTROL FACTORS IN MUSICAL EXPRESSIONS |
|---|---|---|---|---|---|---|---|---|---|---|---|
| | | TOUCH | TOUCH→M1 | VELOCITY ON | KEY STROKE | HAMMER PRESSURE | KEY PRESSURE | LEFT/RIGHT KEY DEPRESSION | VELOCITY OFF | | |
| BOWED STRINGED INSTRUMENTS *VIOLIN *VIOLA *CELLO *CONTRABASS | DETACHE | | | | ○ | | | | | TONE COLOR CONTROL BY BRIGHT PEDAL | |
| | SPICCATO | ○ | | | ○ | | | | | SAME PERFORMANCE TECHNIQUE OF STACCATO | |
| | PIZZICATO | | | | ○ | | | | | PIZZICATO TONE COLOR WITH DEEP DEPRESSION OF BRIGHT PEDAL | |
| | CORRENTE | | | | | | | | | ANOTHER TONE COLOR DUE TO SPECIAL PERFORMANCE TECHNIQUE | |
| REED INSTRUMENTS *SAXOPHONE *CLARINET *OBOE *ENGLISH HORN HORN *BASSOON | TONGUING | | | | ○ | | | | | TONE COLOR CONTROL BY BRIGHT PEDAL | |
| | GROWL | | | | | | | | | ANOTHER TONE COLOR | |
| | TIGHTENING LIPS | | | | ○ | | | | | TONE COLOR CONTROL BY BRIGHT PEDAL | |
| | HOLD REED IN MOUTH | | | | ○ | | | | | SAME ABOVE | |
| | BLOWING INTENSITY | | | ○ | | ○ | ○ | | | TONE VOLUME CONTROL BY VELOCITY, PRESSURE, STROKE (ACCELERATION) | |
| | | | | | | | | | | | |
| BRASS INSTRUMENTS *CORNET *TRUMPET *TROMBONE *HORN *TUBA | TONGUING | | | | ○ | | | | | TONE COLOR CONTROL BY BRIGHT PEDAL | |
| | FLUTTER | | | | | | | | | ANOTHER TONE COLOR | |
| | TIGHTENING LIPS | | | | ○ | | | | | TONE COLOR CONTROL BY BRIGHT PEDAL | |
| | ANGLE OF LIPS | | | | ○ | | | | | SAME ABOVE | |
| | SHAKE, TRILL | | | | ○ | | | | | TONE COLOR CONTROL BY SHAKE PEDAL | |
| | | | | | | | | | | | |
| KEYBOARD INSTRUMENT *PIANO | ITCHY-DAMPER | | | ○ | | ○ | | | | SOFTLY PLAY A KEY FOR WHICH REVERBERATION REMAINS | RR |

FIG.9

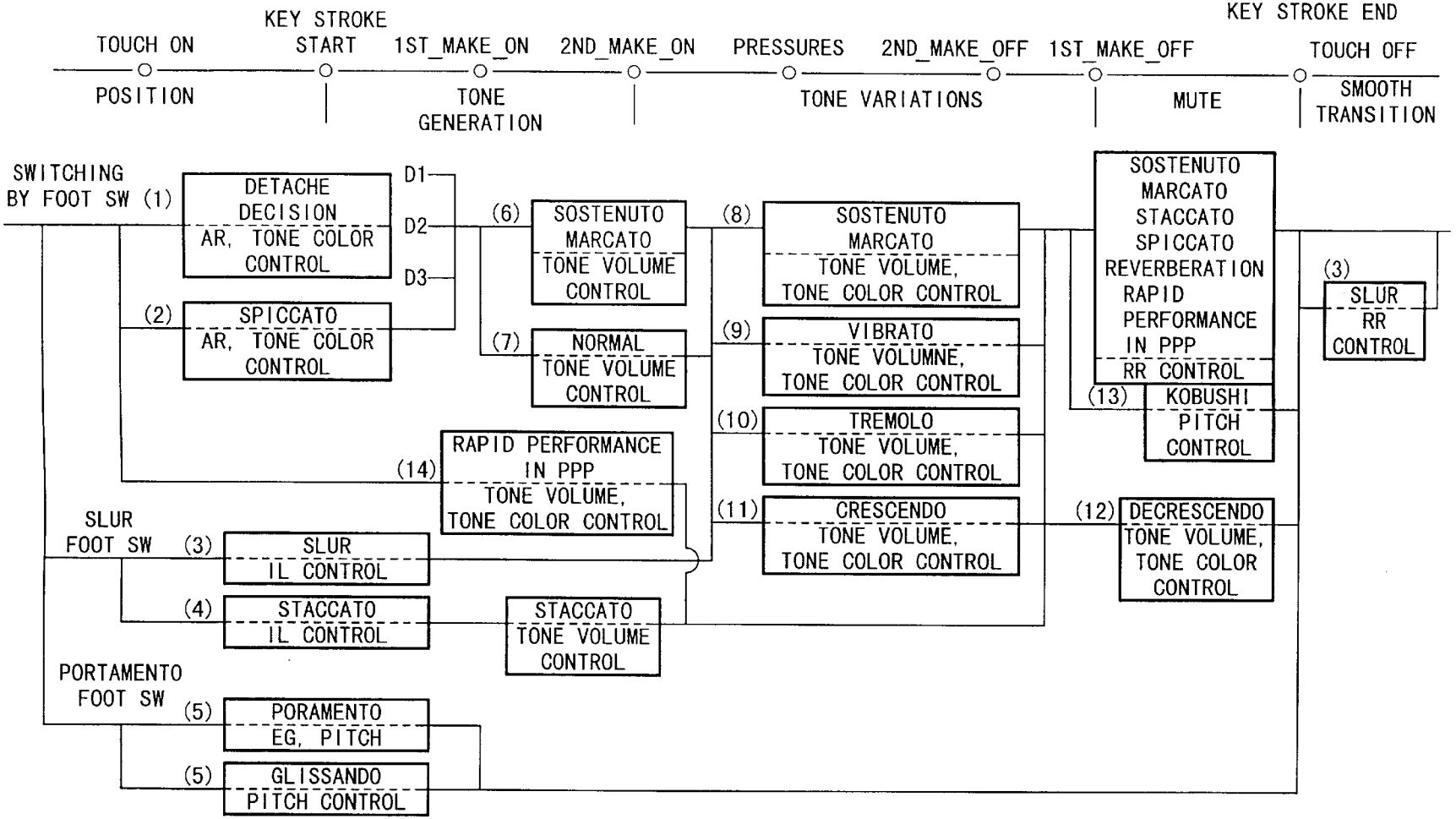
FIG.10 (STATE TRANSITION DIAGRAM FOR BOWED STRINGED INSTRUMENTS)

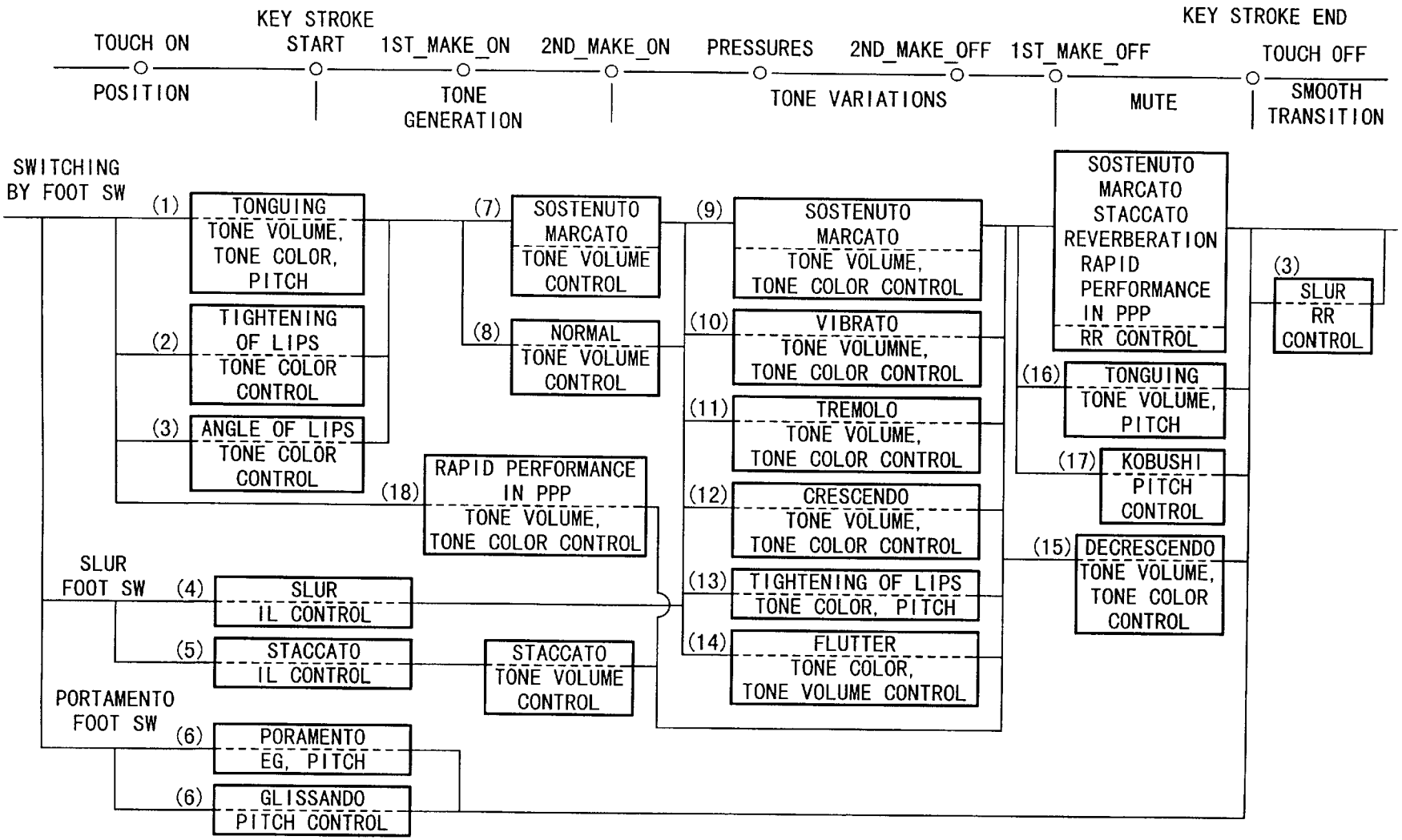
FIG.11 (STATE TRANSITION DIAGRAM FOR BRASS INSTRUMENTS)

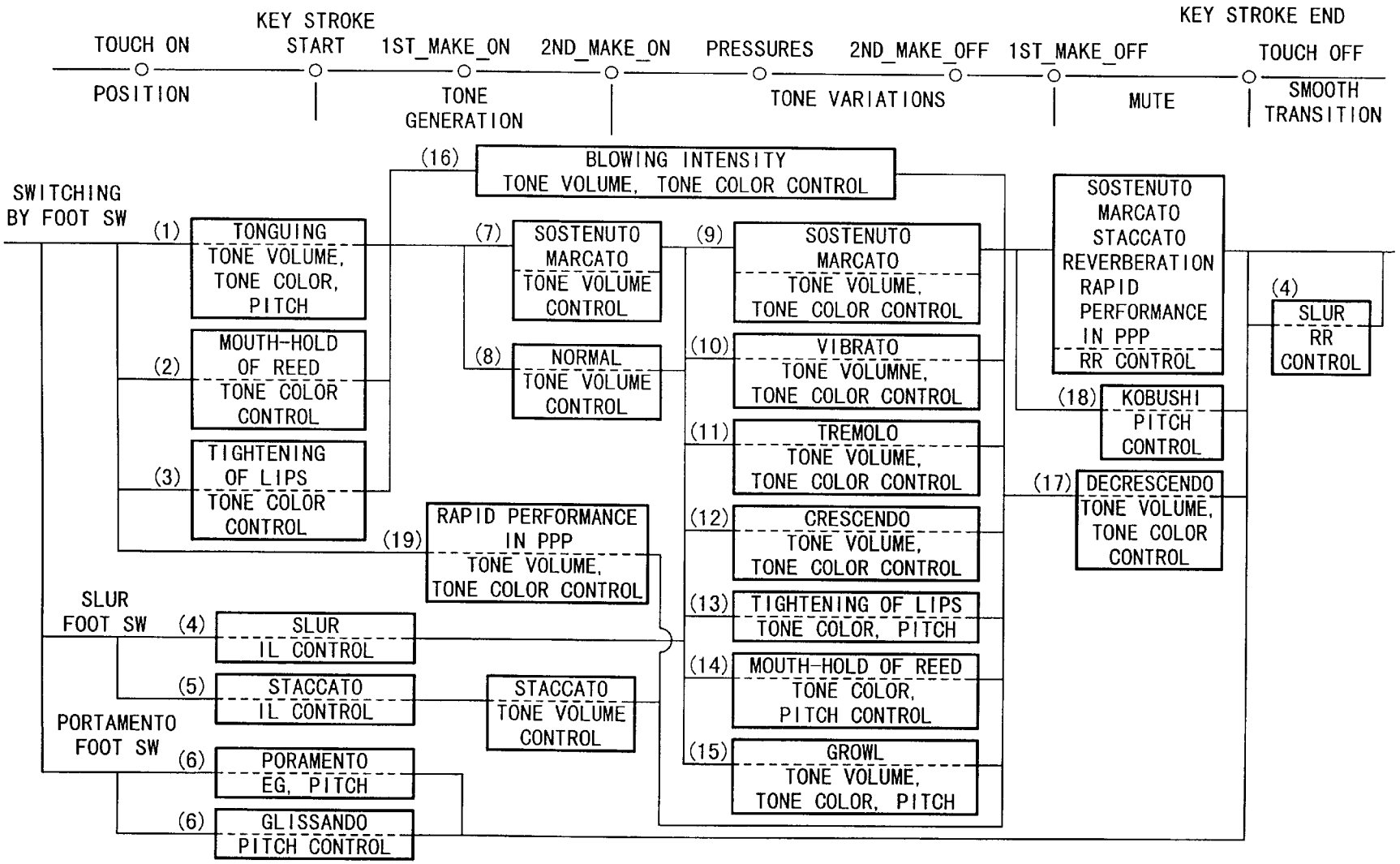
FIG.12 (STATE TRANSITION DIAGRAM FOR REED INSTRUMENTS)

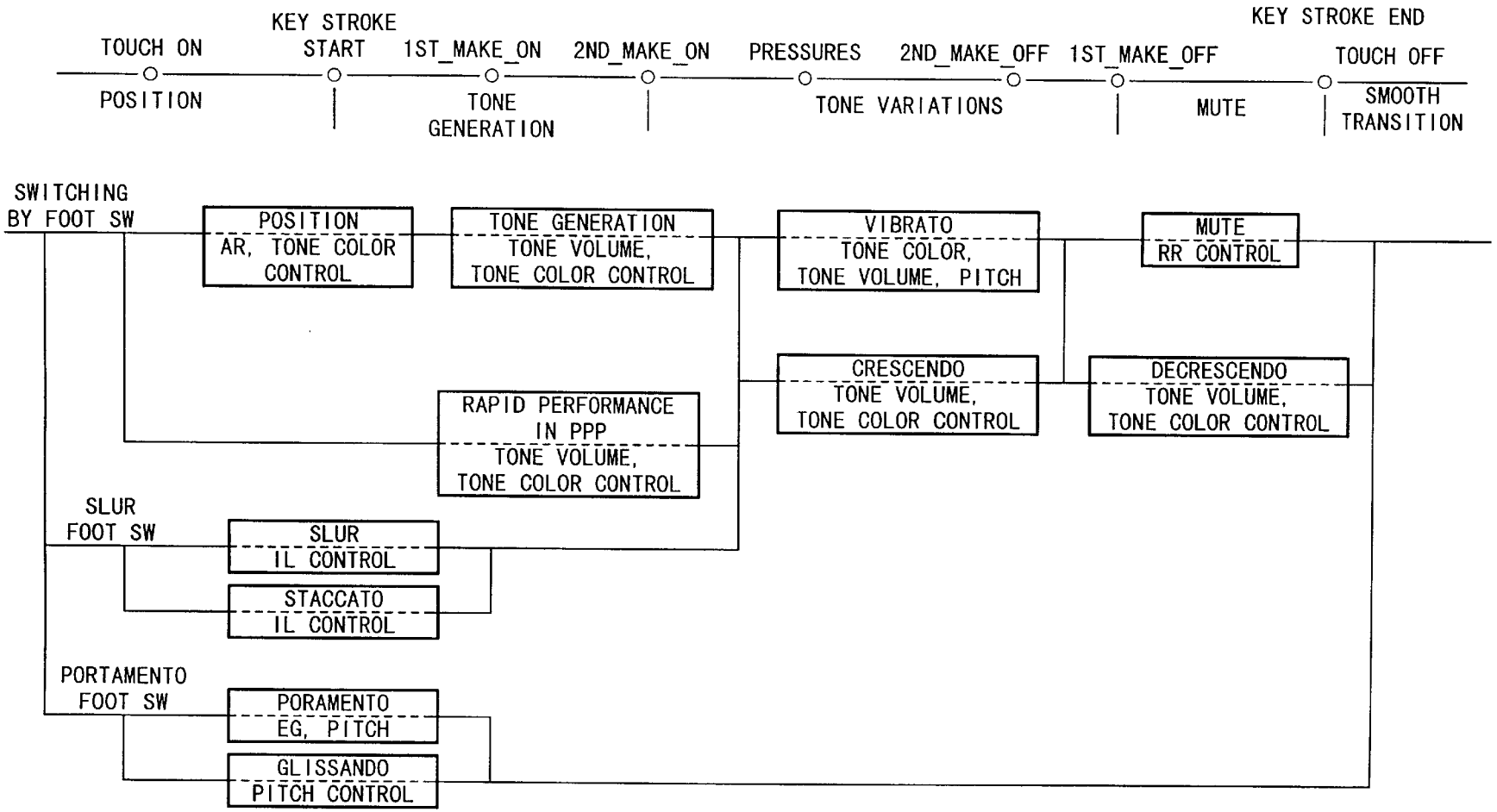
FIG.13 (STATE TRANSITION DIAGRAM FOR ALL INSTRUMENTS)

ELECTRONIC KEYBOARD INSTRUMENT

BACKGROUND OF THE INVENTION

1. Field of the Invention

This invention relates to electronic musical instruments that use keyboards to simulate performance techniques being manually effected on acoustic instruments.

2. Description of the Related Art

Conventionally, there are provided electronic musical instruments equipped with keyboards containing keys, which will be referred to as "electronic keyboard instruments". Some electronic keyboard instruments are designed to control musical tones based on a variety of performance techniques (or executions) which are detected. So, there are a variety of documents teaching the aforementioned electronic keyboard instruments, as follows:

(1) Japanese Unexamined Patent Publication No. Hei 2-146596 (referred to as "document 1") discloses a musical tone control method for an electronic musical instrument based on performance techniques such as "legato" and "staccato", for example. Herein, the electronic musical instrument controls musical tones by detecting performance techniques based on operating conditions of performance operators (e.g., keys, switches and controls). The operating conditions of the performance operators are related to initial-touches, after-touches, key-on times, etc. So, performance techniques such as "tenuto", "staccato" and "decrescendo", all of which are Italian musical terms, are detected based on those operating conditions of the performance operators, so that musical tones are being controlled in response to the detected performance techniques.

(2) Japanese Unexamined Patent Publication No. Hei 3-116096 (referred to as "document 2") discloses an electronic musical instrument designed to automatically simulate performance techniques of acoustic instruments such as violins, brass instruments and guitars, for example. Herein, the electronic musical instrument controls musical tones in accordance with performance technique programs, which are selected in response to tone colors being selected by users. The performance technique programs are provided for simulation (or imitation) of characteristics in sound generation of acoustic instruments. For example, violins have following characteristics:

(i) To change a sound to another one being played on a same string, a player normally changes his or her fingering position to depress the string while moving a bow continuously. In this case, sounds are changed over continuously without breaks. This brings a musical effect such as "portamento".

(ii) When the player changes a string presently being played to another one, the player's finger and bow naturally leave from the string. In this case, sounds are changed discontinuously with breaks. This does not bring the musical effect of portamento with ease.

(iii) Normally, a number of sounds being produced simultaneously is limited to one or two, for example.

To cope with the aforementioned characteristics of the violin, which is designated as the tone color being actualized on the electronic musical instrument, the document 2 teaches musical tone generation controls by following conditions:

(i) Suppose that two sounds are being generated sequentially. If a preceding sound and a present sound belong to a register corresponding to a same single string of the violin, the electronic musical instrument automatically imparts a portamento effect with respect to switching from the preceding sound to the present sound.

(ii) If the preceding sound and present sound do not belong to the register corresponding to the same single string of the violin, the electronic musical instrument starts generating the present sound after the preceding sound without using the portamento effect.

(iii) A number of sounds being generated simultaneously is limited to two.

Thus, the electronic musical instrument having a keyboard is capable of obtaining performance effects on simulation (or imitation) of the characteristics of the violins.

The electronic keyboard instrument of the document 1 is designed to detect the performance techniques by scanning all sensor outputs and operating states of the keyboard. If the electronic keyboard instrument is further increased in number of sensors being equipped and kinds of performance techniques being detected, it takes much processing time in scanning the sensors and detecting the performance techniques. So, the electronic keyboard instrument of the document 1 suffers from problems on processing speeds.

The performance technique programs employed in the electronic keyboard instrument of the document 2 are not provided to directly detect the performance techniques such as tenuto, staccato and decrescendo. But, they are provided to obtain performance effects simulating characteristics of acoustic instruments by discriminating conditions, which are being extracted from the characteristics of the acoustic instruments. In short, the document 2 does not contribute to detection of the performance techniques in general. In addition, the electronic keyboard instrument of the document 2 is not equipped with touch sensors, so it is not designed to detect the performance techniques based on performance information data being given from a variety of sensors.

SUMMARY OF THE INVENTION

It is an object of the invention to provide an electronic keyboard instrument that is capable of simulating performance techniques of acoustic instruments with rich expression in music performance.

An electronic keyboard instrument of this invention is basically configured by a keyboard, a microcomputer, a tone generator and a sound system as well as sensors, switches and foot switches. Each of keys of the keyboard is equipped with a variety of sensors and switches such as a touch sensor, make switches (1M, 2M), a key-stroke sensor, key-depression pressure sensors and a hammer-depression pressure sensor, while the foot switches correspond to a damper pedal, a soft pedal and a sostenuto pedal as well as a slur foot switch and a portamento foot switch. Herein, various acoustic instruments are related to different performance techniques respectively. So, operating a foot switch designates a specific performance technique detection rule in response to a desired tone color corresponding to an acoustic instrument whose sounds are being simulated. Then, a performance technique is detected in accordance with the performance technique detection rule on the basis of outputs of the sensors, at least one of which is selectively used. Thus, the tone generator generates musical tones with respect to the tone color, wherein the musical tones are controlled in response to the performance technique with respect to at least one tone factor (e.g., a tone volume, tone color and pitch). Incidentally, operating the slur foot switch designates a slur-related performance technique detection rule for detection of performance techniques such as slur and staccato. In addition, operating the portamento foot switch designates a portamento-related performance technique detection rule for detection of performance techniques such as portamento and glissando.

Among the sensors, the touch sensor detects a touch of a performer's finger on the key, the key-depression pressure sensors respectively detect left and right key-depression pressures being applied to the key, and a hammer-depression pressure sensor detects a hammer-depression pressure being applied to a hammer interlocked with the key. In addition, in response to rapid variations that occur on the left and right key-depression pressures being applied to the key, it is possible to detect special performance techniques such as tremolo and vibrato. Further, an initial touch is detected by measuring a time that elapses from a timing to turn the 1M switch ON to a timing to turn the 2M switch ON.

Because this invention is designed to detect performance techniques in accordance with performance technique detection rules, each of which is determined in response to the tone color designated by the performer, it is possible to promptly actualize various performance techniques of acoustic instruments being simulated without increasing processing time. So, the electronic keyboard instrument of this invention is rich in musical expressions simulating the performance techniques of the acoustic instruments on the keyboard.

BRIEF DESCRIPTION OF THE DRAWINGS

These and other objects, aspects and embodiment of the present invention will be described in more detail with reference to the following drawing figures, of which:

FIG. 6 shows a list showing relationships between musical expressions, musical factors and musical effects with respect to common acoustic instruments;

FIG. 7 shows a list showing relationships between musical expressions, musical factors and musical effects with respect to various kinds of acoustic instruments respectively;

FIG. 8 is a list showing relationships between musical expressions, sensors and switches of a keyboard, controls for actualization of performance techniques on the keyboard and control factors in musical expressions with respect to common acoustic instruments;

FIG. 9 is a list showing relationships between musical expressions, sensors and switches of a keyboard, controls for actualization of performance techniques on the keyboard and control factors in musical expressions with respect to various kinds of acoustic instruments respectively FIG. 10 is a state transition diagram showing a sequence for detection of outputs of sensors and switches and a sequence for detection of performance techniques on the keyboard of the electronic musical instrument with regard to bowed stringed instruments;

FIG. 11 is a state transition diagram showing a sequence for detection of outputs of sensors and switches and a sequence for detection of performance techniques on the keyboard of the electronic musical instrument with regard to brass instruments;

FIG. 12 is a state transition diagram showing a sequence for detection of outputs of sensors and switches and a sequence for detection of performance techniques on the keyboard of the electronic musical instrument with regard to reed instruments; and FIG. 13 is a state transition diagram showing a summary of the sequences with regard to all of the bowed stringed instruments, brass instruments and reed instruments.

DESCRIPTION OF THE PREFERRED EMBODIMENT

This invention will be described in detail by way of examples with reference to the accompanying drawings.

Figure 1:
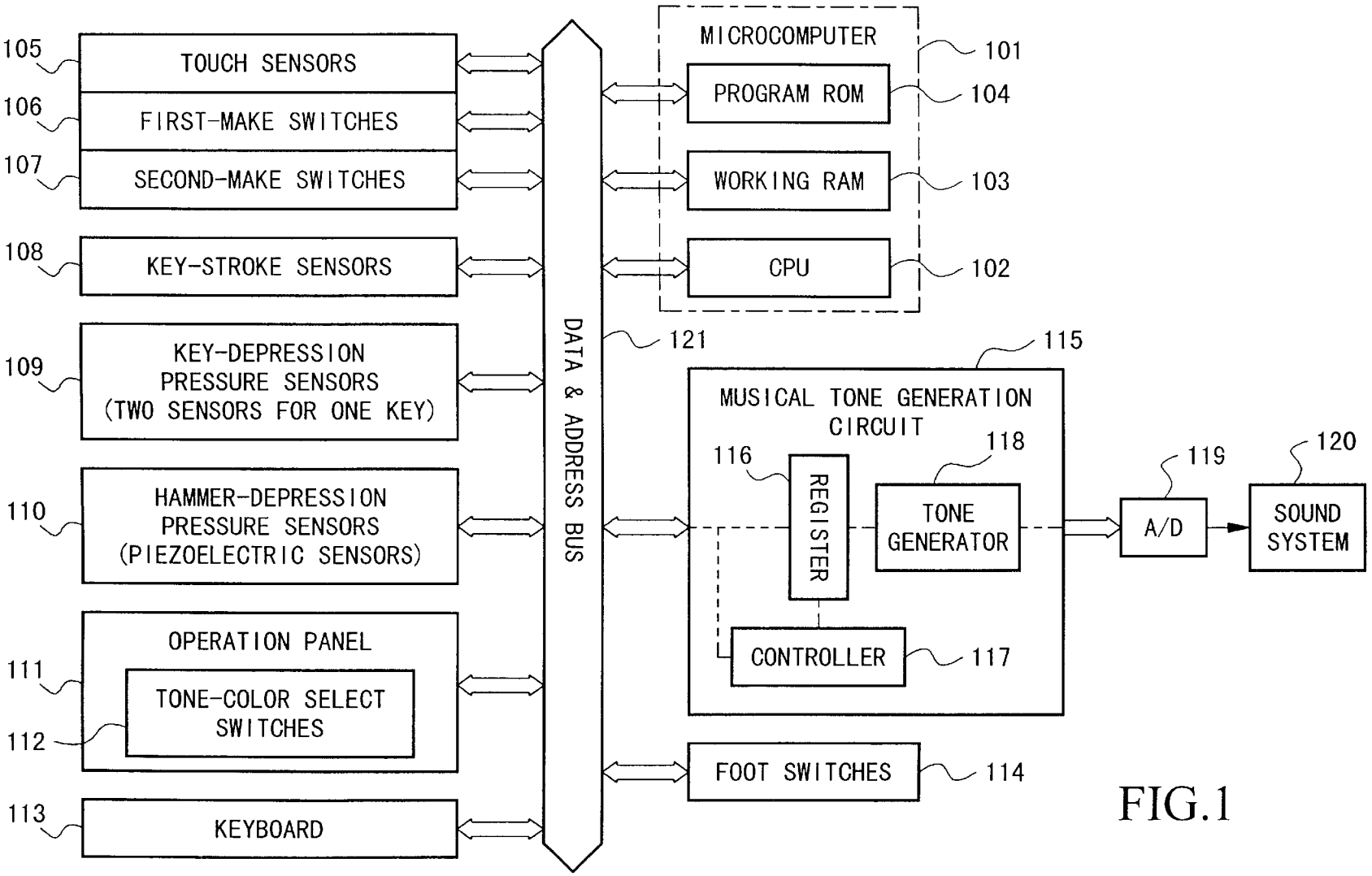
FIG 1. is a block diagram showing a configuration of an electronic musical instrument in accordance with preferred embodiment of the invention.

FIG. 1 is a block diagram showing a configuration of an electronic musical instrument in accordance with the preferred embodiment of the invention. The electronic musical instrument of FIG. 1 contains a microcomputer 101, touch sensors 105, first-make switches 106, second-make switches 107, key-stroke sensors 108, key-depression pressure sensors 109, and hammer-depression pressure sensors 110 as well as an operation panel 111, a keyboard 113, foot switches 114, a musical tone generation circuit 115, a digital-to-analog (D/A) converter 119, a sound system 120 and a data/address bus 121.

The microcomputer 101 is configured by a central processing unit (CPU) 102, a working random-access memory (RAM) 103 and a program read-only memory (ROM) 104. Herein, the CPU 102 controls overall operations of the electronic musical instrument. The working RAM 103 is used as a work area (or work areas) for assisting operations of the CPU 102. Various kinds of registers and flags are set to the work area. The program ROM 104 stores control programs being executed by the CPU 102.

The operation panel 111 contains switches and controls, which are operated by a user to conduct various kinds of setting operations. Particularly, the operation panel 111 contains tone-color select switches 112, which are operated by the user. The CPU 102 detects operations applied to the tone-color select switches 112 respectively. When the user operates the tone-color select switch 112, the CPU 102 detects its operation to produce tone-color information representative of the corresponding tone color. The tone-color information is sent to the musical tone generation circuit 115 by way of the data/address bus 121. Thus, the specific tone color is set to the musical tone generation circuit 115. The keyboard 113 contains a number of keys, which are manually operated (or depressed) by the user for musical performance. The CPU 102 detects performance operations applied to the keys of the keyboard 113, so that it instructs the musical tone generation circuit 115 to generate musical tones in response to the performance operations.

The aforementioned sensors (105, 108–110) and switches (106, 107) are provided for detecting performance information representing touches or other performance factors in connection with the performance operations being applied to the keyboard 113. The sensors and switches are each provided for the keys of the keyboard 113 respectively. Arrangements and locations of the sensors and switches will be described in detail with reference to FIG. 3.

The touch sensors 105 are provided to detect touches of fingers on the keys of the keyboard 113. That is, the touch sensor 105 is ON when the finger touches the key, while it is OFF when the finger does not touch the key. Incidentally, the touch sensor can be called a zero-make switch (or 0M switch) because it is initially ON when the finger touches the key before the first-make switch (or 1M switch) and second-make switch (or 2M switch) are ON.

A pair of the 1M switch 106 and 2M switch 107 are switches for detecting that the key is being operated. Namely, when the key is operated, the 1M switch 106 is firstly turned ON, then, the 2M switch 107 is turned ON. The CPU 102 is capable of measuring a time which elapses from a first timing when the touch sensor 105 is ON to a second timing when the 1M switch 106 is ON. In addition, by measuring a time which elapses from the timing when the 1M switch 106 is ON to a next timing when the 2M switch 107 is ON, it is possible to produce a key velocity (i.e., initial-touch data) after the timing when the 1M switch is ON.

The key-stroke sensors 108 detect key strokes with respect to keys of the keyboard 113. That is, the key-stroke sensor 108 produces an amount of depression by which the key is being depressed. The key-depression pressure sensors 109 detect and produce key-depression pressures applied to the keys, which are depressed to lowest positions respectively. Herein, two sensors are arranged in parallel with respect to each key, wherein they respectively detect key-depression pressures being applied to left and right portions of the key. So, it is possible to detect lateral movements of the finger on the key, which is depressed to its lowest position. Namely, it is possible to detect performer's complicated operations in which the performer depresses the key to its lowest position and moves the finger in right-left directions on the key. The hammer-depression pressure sensors detect and produce hammer-depression pressures of hammers, which are depressed down in response to the keys which are depressed.

The performer turns the foot switches turns the foot switches 114 ON or OFF with his or her foot (or feet). Concretely speaking, foot switches are provided for three pedals, i.e., a damper pedal, a soft pedal and a sostenuto pedal (i.e., sustaining pedal), which are normally installed in the piano. In addition, the electronic musical instrument of the present embodiment is equipped with other foot switches, i.e., a slur foot switch and a portamento foot switch.

The musical tone generation circuit 115 generates musical tone signals based on instructions given from the CPU 102. Herein, the CPU 102 produces a variety of parameters for generation of musical tones on the basis of detection results of the sensors (105, 108–110, 114) and outputs of the switches (106, 107). Those parameters are set to a buffer register 116 under control of a controller 117 within the musical tone generation circuit 115. A tone generator (or sound source) 118 reads out the parameters from the buffer register 116 at prescribed timings, so that it generates "digital" musical tone signals based on instructions given from the CPU 102. The D/A converter 119 converts the digital musical tone signals to analog signals, which are forwarded to the sound system 120. Hence, the sound system 120 produces musical tones corresponding to the musical tone signals.

Figure 2:
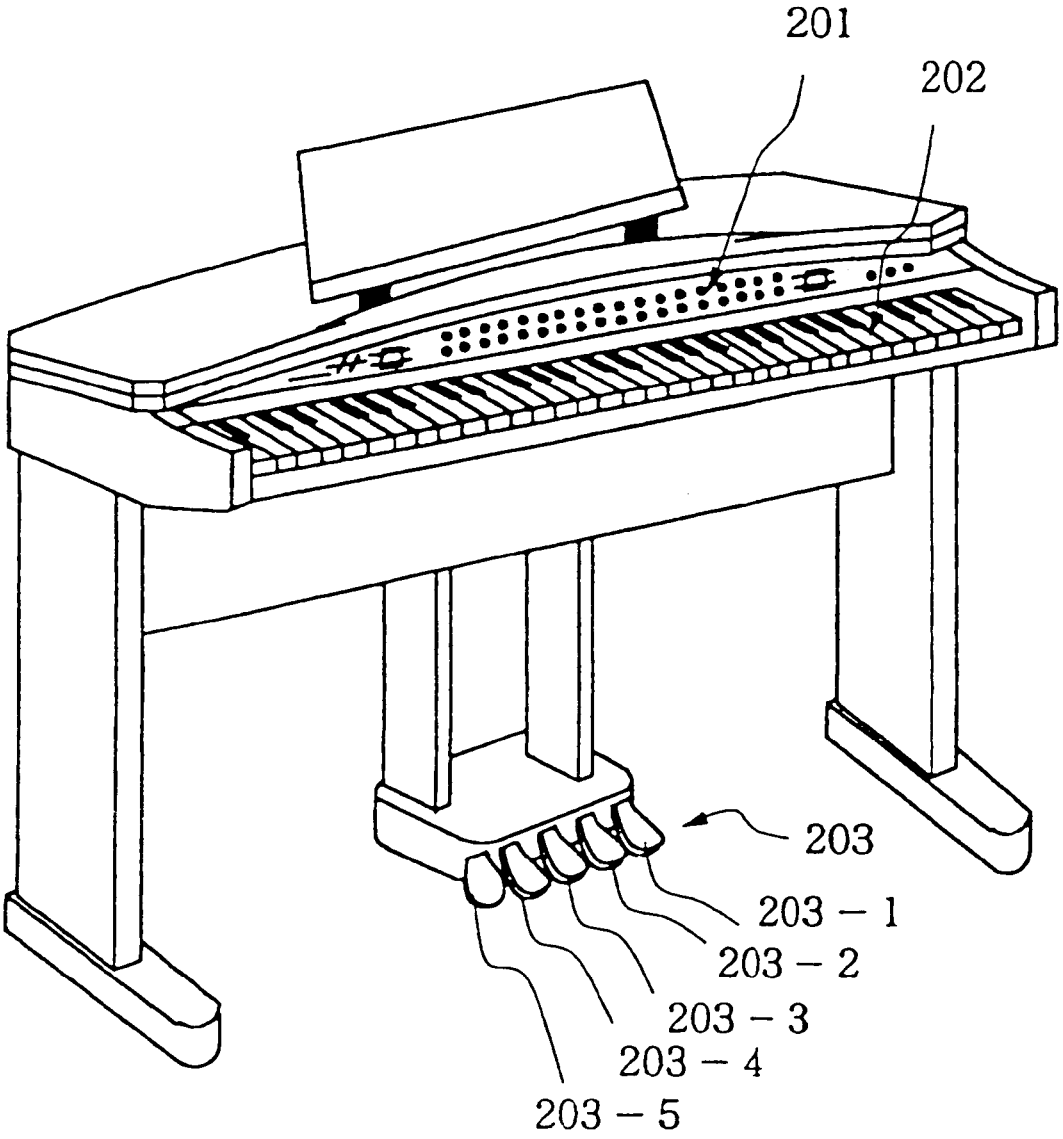
FIG. 2 is a perspective view showing an overall appearance of the electronic musical instrument.

FIG. 2 shows an actual appearance of the electronic musical instrument shown in FIG. 1. Herein, a reference numeral 201 designates an appearance of the operation panel 111, and a reference numeral 202 designates an appearance of the keyboard 113. Further, a reference numeral 203 designates foot pedals, which are provided in connection with the foot switches 114. Specifically, there are provided three pedals, i.e., a damper pedal 203-1, a soft pedal 203-2 and a sostenuto pedal 203-3. In addition, a reference numeral 203-4 designates the slur foot switch, and a reference numeral 203-5 designate the portamento foot switch.

Figure 3:
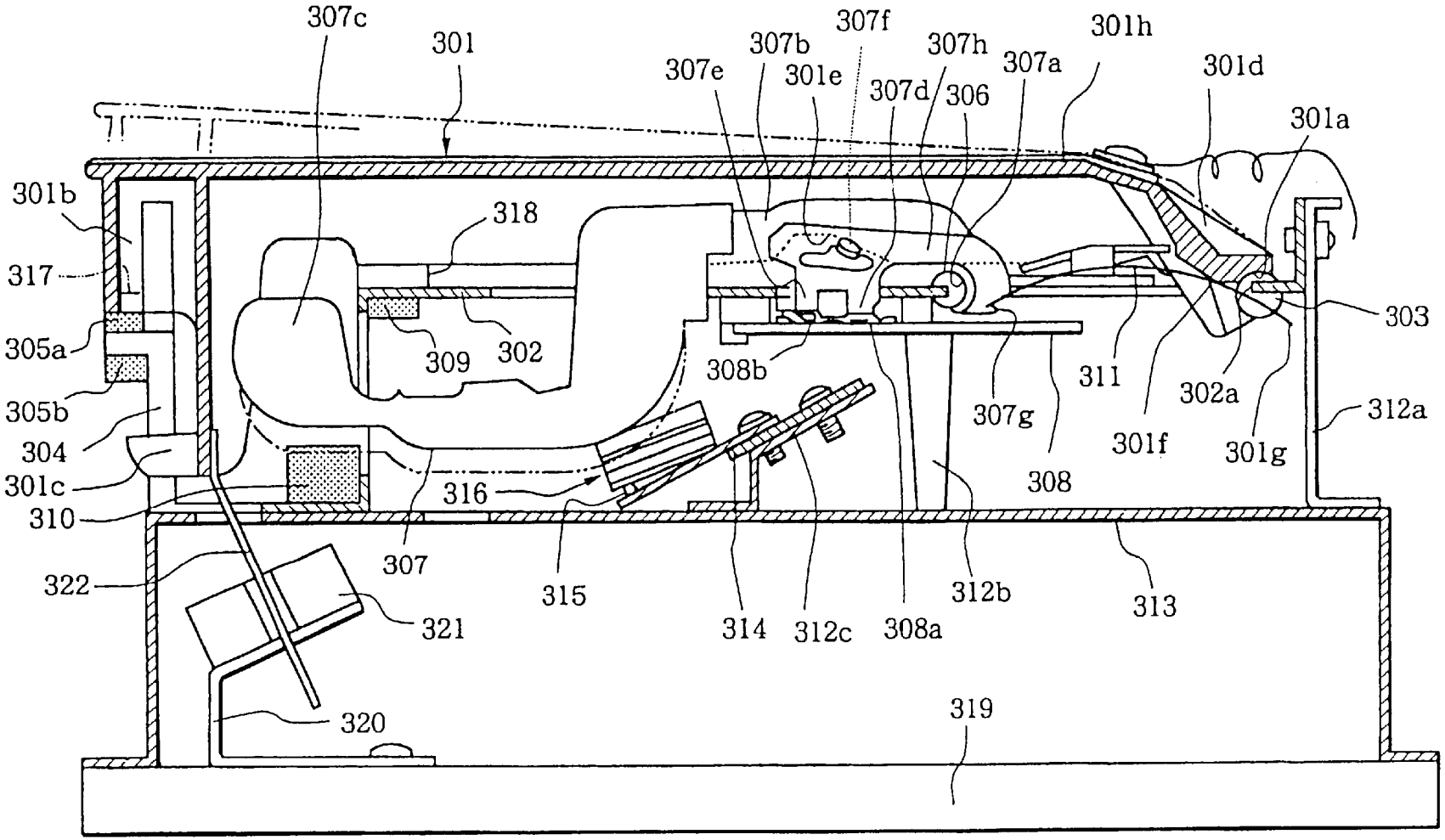
FIG. 3 is a longitudinal sectional view showing a partial construction of a keyboard of the electronic musical instrument.

FIG. 3 is a longitudinal sectional view showing a partial construction of the keyboard 202. In the keyboard 202, a key (e.g., white key 301) is arranged and supported on a key frame 302, as follows:

Parts of the key 301 are formed integrally by resin material so that the key 301 has a reversed rectangular-U-shape in section, by which a lower side of the key 301 is opened. The key 301 is equipped with a recess portion 301*a* at a backend portion thereof. The recess portion 301*a* has an interior cylindrical shape, which acts as a key-support point. The recess portion 301*a* engages with a support pin 303, which has a circular shape in section and which is securely fixed to a predetermined position of the key frame 302, in such a manner that the key 301 is capable of freely moving up and down. The key frame 302 (simply referred to as a "frame") is made of sheet metal to act as a key support member. Incidentally, the support pin 303 is subjected to "out-sert" formation at a backend of a "rectangle" slit 302*a*, which is formed at a selected position of the frame 302.

The key 301 has a surface, which is directly touched by a performer's finger. A thin conductor 301*h* is arranged on the surface of the key 301 as a touch sensor. Thus, it is possible to detect a finger touch on the surface of the key 301 by a detection circuit (not shown). When the finger touches the key 301, the touch sensor is ON. When the finger leaves from the key 301, the touch sensor is OFF. Thus, the thin conductor 301*h* corresponds to the aforementioned touch sensor 105.

Stopper elements 301*b*, 301*c* are formed to hang down from side walls of a front portion of the key 301, wherein they are formed integrally with the key 301. A key guide 304 is planted at a selected position on a front-end portion of the frame 302 with respect to the key 301. A lower-limit stopper 305*a* and an upper-limit stopper 305*b* are adhered to a horizontal surface of the key guide 304 at selected positions in different elevations. Thus, the key 301 is restricted in up-down movements such that the stopper elements 301*b*, 301*c* are brought in contact with the stoppers 305*a*, 305*b* respectively.

A support pin 306 is arranged at a front-end portion of the slit 302*a* of the frame 302. Herein, the support pin 306 is formed integrally with the frame 302 by out-sert formation. The support pin 306 engages with a concave portion 307*a* of a hammer 307, which is a mass body, to actualize a second support point (or support point of mass body). Thus, the hammer 307 can freely move up and down about the support point in response to depression of the key 301. The hammer 307 includes a core member 307*b*, made of a metal piece, to have a certain mass which is determined in advance. A rim portion of the core member 307*b* is fringed with resin material by out-sert process. Thus, the hammer 307 has a center of gravity, which is moved close to a tip portion 307*c* in a longitudinal direction.

Forked switch pressing portions 307*d*, 307*e* are arranged in proximity to the support pin 306 corresponding to the support point of the hammer 307, wherein they project downward from the hammer 307. In addition, projecting portions 307*f* project from an out-sert member 307*h* on both sides of the core member 307*b*. In response to depression, concave portions 301*e*, which are formed on both sides of the key 301, move downwardly to depress the projecting portions 307*f* of the hammer 307, so that the hammer 307 is being subjected to rotary movement in a by counterclockwise direction. Due to the rotary movement of the hammer 307, the forked switch pressing portions 307*d*, 307*e* descend down, so that they respectively come in contact with a first-make (1M) switch 308*a* and a second-make (2M) switch 308*b*, which are mounted on a circuit board 308 being fixed to the frame 302. Thus, the switches 308*a*, 308*b* are respectively turned on to produce a musical tone generation signal. An upper-limit stopper 309 is adhered to a selected lower surface of the frame 302, while a lower-limit stopper 310 is adhered to a selected upper surface of the frame. So, the hammer 307 is restricted in rotary movement in clockwise and counterclockwise directions by those stoppers 309, 310 respectively. Incidentally, the 1M switch 308 corresponds to the aforementioned 1M switch 106, while the 2M switch 308*b* corresponds to the aforementioned 2M switch 107 shown in FIG. 1.

A plate spring 311 having a short-strip shape is arranged between a hold portion 301*f*, which is a selected lower surface of the back-end portion 301*d* of the key 301, and a termination channel 307*g*, which is formed at a back-end portion of the hammer 307. Herein, the plate spring 311 contains a attachment hold portion 301*g*, which is formed and arranged in proximity to the back-end portion of the key 301. The plate spring 311 normally presses the key 301 to rotate in a clockwise direction. In addition, it also presses the recess 301*a* of the key 301 to come in contact with the support pin 303. Further, it presses the hammer 307 to rotate in the clockwise direction. Furthermore, it presses the concave portion 307*a* of the hammer 307 to come in contact with the support pin 306.

The frame 302 is securely fixed to a shelf board (or keybed) 313, which is placed horizontally, by way of stays 312*a*, 312*b*. A base member 314, which is made of elastic material, is arranged above the board 313 by way of a stay 312*c* in such a way that it is being slanted with a certain angle. Herein, the base member 314 extends downwardly in a slanted manner. A stress concentration member 315 is arranged on a surface of a tip of a back portion of the base member 314. The stress concentration member 315 is made of hard material in a needle shape or a hook shape. A piezoelectric sensor 316 is arranged on the stress concentration member 315 along the back portion of the base member 314. The piezoelectric sensor 316 has a cushion member, which is brought in contact with a selected lower surface of the hammer 307. The piezoelectric sensor 316 corresponds to the aforementioned hammer-depression pressure sensor 110 shown in FIG. 1.

Key-depression pressure sensors 318 are arranged on a selected upper surface of the frame 302. The key-depression pressure sensors 318 correspond to two piezoelectric sensors, which are located in connection with side walls of the key 301 having the reversed rectangular-U-shape. That is, the piezoelectric sensors are respectively arranged at positions, at which they are brought in contact with lower ends of the side walls of the key being depressed. Incidentally, the key 301 has two side walls, i.e., a left side wall and a right side wall, which are observed from a viewpoint of a performer who sits in front of the keyboard 202. So, the piezoelectric sensor which is brought in contact with the lower end of the left side wall is called a left key-depression pressure sensor, while the piezoelectric sensor which is brought in contact with the lower end of the right side wall is called a right key-depression pressure sensor. Those key-depression pressure sensors 318 correspond to the aforementioned key-depression pressure sensors 109 shown in FIG. 1.

The shelf board 313 is securely fixed to a base 319, which is equipped with an attachment member 320. A key-stroke sensor 321 is mounted on the attachment member 320. The key-stroke sensor 321 is a coil having a hollow cylindrical shape. A rod member 322 is arranged to penetrate through an inside of the "hollow" key-stroke sensor 321. One end of the rod member 322 is securely attached to a root portion of the stopper element 301*c* of the key 301. Thus, the key-stroke sensor 321 detects a stroke operation of the key 301. The key-stroke sensor 321 corresponds to the aforementioned key-stroke sensor 108 shown in FIG. 1.

The above description is made with respect to the white key and its related members. Of course, the keyboard 202 contains black keys in addition to the white keys. Relationships between the white key and its related members are similarly established between the black key and its related members. Hence, the present specification omits a description with regard to the black key and its related members.

Next, a description will be given with respect to a sequence of outputs of switches and sensors, which respond to a key-depression event in which a performer depressed a key of the keyboard. When the performer touches the key (301) with his or her finger, the touch sensor 301 *h* (or 105 in FIG. 1) is turned ON. Then, the performer starts depressing the key deeply, so the key-stroke sensor 321 (or 108 in FIG. 1) detects a key-depression operation (or key-stroke start event) so as to outputs a detection result thereof. In addition, a connection is established on contacts of the 1M switch 308*a* (or 106 in FIG. 1) which is being turned ON, then, a connection is established on contacts of the 2M switch 308*b* (or 107 in FIG. 1) which is being turned ON. In response to a key-depression intensity being applied to the key, the piezoelectric sensor 316 (or hammer-depression pressure sensor 110 in FIG. 1) changes an output voltage thereof. Herein, the piezoelectric sensor can be configured as an electric resistance variation type in which an output varies substantially in proportion to vertical pressure applied thereto. Or, it can be configured as a impact sensor using a piezoelectric component in which an output is equivalent to a value which is obtained by performing differentiation on vertical pressure with respect to time. The key-depression pressure sensor 318 (or 109 in FIG. 1) detects key-depression pressure which is applied to the key by the performer's finger and whose value is defined when the key is placed in a depressed state. Thus, the key-depression pressure sensor 318 outputs the detected value of the key-depression pressure. After completing key depression, the performer starts to release the key. Then, the contacts are disconnected to that the 2M switch 308*b* is turned OFF. In addition, the contacts are disconnected so that the 1M switch 308*a* is turned OFF. Thereafter, the key-stroke sensor 321 detects an end of the key depression. Further, the touch sensor 301*h* detects an event in which the performer lifts his or her finger off from the key.

The present embodiment is designed such that as shown in FIG. 3, the piezoelectric sensor 316 is placed to come in contact with the lower surface of the center portion of the hammer 307. This invention is not necessarily constructed like the present embodiment. Hence, it is possible to modify the present embodiment in such a way that a piezoelectric sensor is arranged on the lower-limit stopper 305*a* of the key 1, which is shown by a dotted-line portion 317. Or, it can be arranged on the lower-limit stopper 310 which comes in contact with the lower surface of the tip-end portion of the hammer 307.

Figure 4:
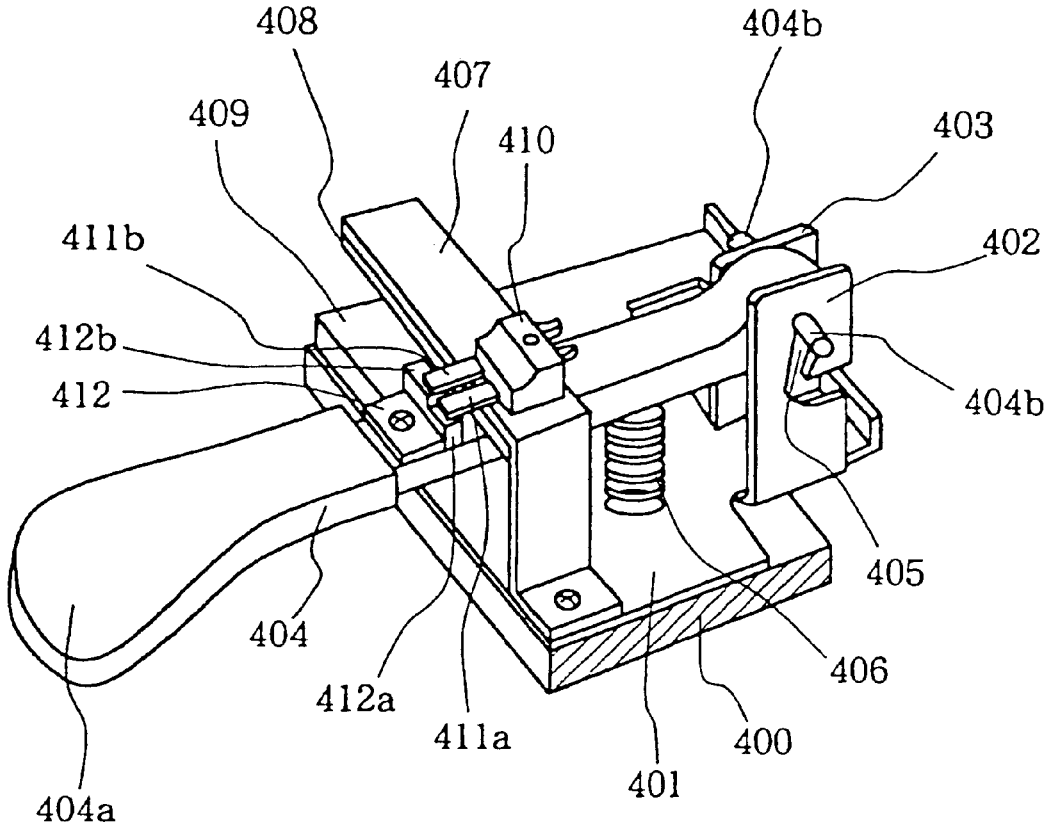
FIG. 4 is a perspective view showing a construction of a foot switch (or foot pedal) shown in FIG. 2.

FIG. 4 shows an example of a construction of a foot switch, which corresponds to one of the foot switches 114 shown in FIG. 1 (or one of the foot pedals 203 shown in FIG. 2). The foot switch of FIG. 4 is constructed on a base 400 of the electronic musical instrument. Herein, a reference numeral 401 designates a frame being fixed on the base 400, while a reference numeral 404 designates a main body of a pedal. The pedal 404 is equipped with an operation portion 404*a*, which is depressed by a performer's foot, at a front portion thereof. In addition, the pedal 404 is equipped with a pin 404*b*, which acts as a center of rotation of the pedal 404, at a back portion thereof. The pin 404*b* is hooked in hooked bores 405, which are formed with hook portions 402, 403 being formed to stand on both sides of a back portion of the frame 401. Thus, the pedal 404 is capable of rotating about an rotation axis corresponding to the pin 404*b*.

A front portion of the frame 401 is equipped with a regulation member 407, which regulates an upward movement of the pedal 404. A felt member 408 is attached to a lower surface of the regulation member 407, which is brought in contact with the pedal 404. In addition, another felt member 409 is attached to an upper surface of the front portion of the frame 401 at a position which is opposite to a position of the felt member 408. Thus, the pedal 404 is limited in upward movement by the felt member 408, while it is limited in downward movement by the felt member 409. A spring 406 is arranged approximately at a center portion of the frame 401. The spring 406 normally presses the pedal 404 upwardly. Therefore, under a non-operation condition where the performer does not operate (or depress) the pedal 404, the pedal 404 is normally pressed upward by the spring 406 to come in contact with the felt member 408.

A switch box 410 is attached to an upper portion of the regulation member 407. The switch box 410 is constructed by switches of two stages. That is, the switch box 410 contains a first switch being turned ON or OFF by a movable element 411*a* and a second switch being turned ON or OFF by a movable element 411*b*. Herein, the movable elements 411*a*, 411*b* extend in a direction toward the operation portion 404*a* of the pedal 404.

Figure 5:
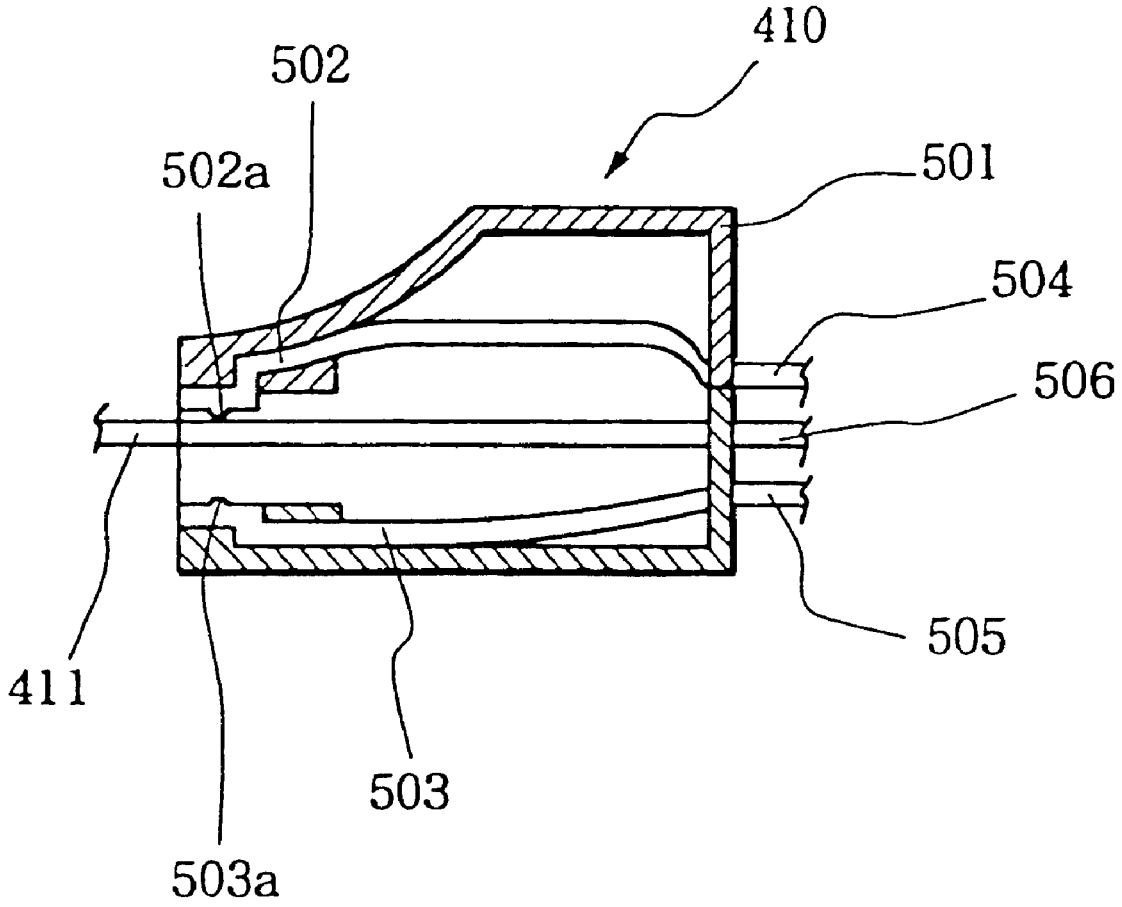
FIG. 5 is a cross sectional view showing a construction of a switch box, which provided for the foot switch shown in FIG. 4.

FIG. 5 shows a sectional construction of the switch box 410. Parts of the switch box 410 are contained in an outer frame 501. An interior space of the switch box 410 is partitioned into two sections, i.e., an upper section and a lower section. The upper section contains a conduction member 502, having a contact 502*a*, an end of which is extended as a terminal 504. The terminal 504 of the conduction member 502 is pulled out from the switch box 410. In addition, the lower section contains a conduction member 503, having a contact 503*a*, an end of which is extended as a terminal 505. The terminal 505 of the conduction member 503 is pulled out from the switch box 410. Further, a movable element 411 (which corresponds to each of the movable elements 411*a*, 411*b* shown in FIG. 4) is arranged to penetrate through approximately a center of the switch box 410. The movable element 411 is made of conductive material having flexibility. The movable element 411 is extended as a terminal 506, which is pulled out from the switch box 410. In an initial condition where no external force is applied to the movable element 411, the movable element 411 is normally placed in contact with the "lower" contact 503*a*. If the movable element 411 is moved upward by the external force, the movable element 411 is brought in contact with the "upper" contact 502*a*.

With reference to FIG. 4, in the non-operation condition where the pedal 404 is not operated (or depressed), the movable elements 411*a*, 411*b* of the two switches which extend outside from the switch box 410 are normally pressed up by a press-up member 412, which is arranged approximately at a center portion of the pedal 404. The press-up member 412 contains press up projections 412*a*, 412*b*. Herein, the press-up projection 412*a* presses up the movable element 411*a* of the first switch, while the press-up projection 412*b* presses up the movable element 411*b* of the second switch. The press-up projections 412*a*, 412*b* differ from each other in heights. Thus, when the pedal 404 is pressed up, the first and second switches are sequentially turned ON in a step-like manner. That is, in the initial condition where the performer does not depress the pedal 404 with his or her foot, both of the movable elements 411*a*, 411*b* are normally pressed up by the projections 412*a*, 412*b* of the press-up member 412. Thus, the movable elements 411*a*, 411*b* are brought in contact with the corresponding "upper" contacts (i.e., 502*a* in FIG. 5). As the performer gradually depresses down the pedal 404, the movable element 411*a* of the first switch firstly leaves from the upper contact, then, it comes in contact with the lower contact (i.e., 503*a* in FIG. 5). If the performer further depresses down the pedal 404 deeply, the movable element 411*b* of the second switch leaves from the upper contact, then, it comes in contact with the lower contact.

For convenience' sake, the following description uses expressions of "slight" depression of the foot switch (or pedal) that turns the first switch ON and "further" depression of the foot switch (or pedal) that turns the second switch ON. Incidentally, when the pedal is returned from a depressed state thereof, the switches are sequentially turned OFF. That is, "slight" return of the foot switch turns the second switch OFF, while "further" return of the foot switch turns the first switch OFF.

Next, descriptions will be given in detail with respect to relationships between musical expressions, performance techniques and sensors of the electronic musical instrument.

FIGS. 6 to 9 show relationships between musical expressions, performance techniques and sensors of the electronic musical instrument. Specifically, FIGS. 6 and 7 are lists showing relationships between musical expressions, musical factors and musical effects with respect to various acoustic instruments. Herein, the musical factors show physical factors related to the musical expressions respectively. In order to perform an acoustic instrument, a performer carries out five steps in production of musical sounds, as follows:

(i) "Position" (or positioning) in preparation for production of musical sounds;

(ii) "Attack" (or start) in production of musical sounds;

(iii) "Sustain" (or variation) in producing musical sounds;

(iv) "Decay" (or mute) musical sounds; and (v) "Smooth" (or connect) musical sounds being sequentially produced.

In the lists of FIGS. 6 and 7, symbols "○" marked for the musical factors designate the corresponding physical factors which are involved with respect to the musical expressions respectively.

For example, the list of FIG. 6 describes various musical expressions, which are commonly effected on playing acoustic instruments respectively. As for "tenuto" within the musical expressions, the list describes a comment of "sufficiently sustain tone volume for each note" as the musical effect. Herein, symbols "○" are marked with respect to all of the five musical factors, i.e., "position" "attack" "sustain" "decay" and "smooth". This indicates that all of the five musical factors are related to the tenuto, which is effected by the performer on the acoustic instrument.

FIG. 7 shows musical expressions with respect to bowed stringed instruments, reed instruments (or wind instruments), brass instruments and keyboard instrument(s) respectively. As for "spiccato" within the musical expressions for the bowed stringed instruments, the list of FIG. 7 describes a comment of "short performance conducted with a center portion of a bow at a rapid tempo" as the musical effect. Herein, symbols "○" are marked with respect to three musical factors, i.e., "position", "attack" and "decay". This indicates that the aforementioned three musical factors are related to the spiccato, which is effected on playing the bowed stringed instrument.

FIGS. 8 and 9 are lists that are created based on the aforementioned lists of FIGS. 6 and 7 respectively. Namely, the lists of FIGS. 8 and 9 show relationships between "musical expressions", "sensors and switches of keyboard", "controls for actualization of performance techniques on keyboard" and "control factors in musical expressions" with respect to various acoustic instruments whose performance techniques are being detected and actualized on the keyboard of the electronic musical instrument. Herein, a column of "sensors and switches of keyboard" contains eight divisions, namely, "touch", "touch→M1", "velocity on", "key stroke", "hammer pressure", "key pressure", "left/right key depression" and "velocity off". In addition, each of those divisions marked with symbols "○" designates its corresponding sensor or switch whose output is used for actualization and detection with respect to each of the musical factors. Namely, the division of "touch" designates the touch sensor 105 (or 301*h* in FIG. 3), and the division of "touch→M1" designate a velocity for the touch sensor 105 and 1M switch 106 (or 308*a* in FIG. 3) which are sequentially operated or a time which elapses from a timing to turn the touch sensor 105 ON to a timing to turn the 1M switch 106 ON. The division of "velocity on" designates a velocity for the 1M switch 106 and 2M switch 107 (or 308*b* in FIG. 3) which are sequentially turned ON or a time which elapses from a timing to turn the 1M switch 106 ON to a timing to turn the 2M switch 107 ON. The division of "key stroke" designates the key-stroke sensor 108 (or 321 in FIG. 3), the division of "hammer pressure" designates the hammer-depression pressure sensor 110 (or 316 in FIG. 3), and the division of "key pressure" designates the key-depression pressure sensor 109 (or 318 in FIG. 3). In addition, the division of "left/right key depression" designates left and right key-depression pressure sensors (109 or 308). Further, the division of "velocity off" designates a velocity for the 2M switch 107 and 1M switch 106 which are sequentially turned OFF or a time which elapses from a timing to turn the 2M switch 107 OFF to a timing to turn the 1M switch 106 OFF. So, each of the musical expressions is related to at least one of the aforementioned divisions regarding the switches and sensors of the keyboard.

To detect a musical expression (or performance technique) of "tenuto" (or "sostenuto", i.e., sustained), for example, the electronic musical instrument uses outputs of the key-stroke sensor 108, hammer-depression pressure sensor 110 and key-depression pressure sensor 109 of the keyboard. To actualize "tenuto" on the keyboard, the electronic musical instrument controls an envelope (i.e., "EG" or envelope generator) of a musical tone based on an output of the key-stroke sensor 108, and it also controls a tone volume of the musical tone based on outputs of the hammer-depression pressure sensor 110 and key-depression pressure sensor 109.

FIGS. 10 to 13 are state transition diagrams, which are created based on contents of FIGS. 6 to 9 that show relationships between musical expressions, performance techniques, switches and sensors of the keyboard of the electronic musical instrument. That is, each state transition diagram shows a sequence for detection of outputs of the sensors and switches as well as a sequence for detection of performance techniques with respect to each of the keys of the keyboard. Namely, FIG. 10 shows a state transition diagram with regard to bowed stringed instruments, FIG. 11 shows a state transition diagram with regard to brass instruments, and FIG. 12 shows a state transition diagram with regard to reed instruments. In addition, FIG. 13 shows a state transition diagram corresponding to a summary of contents of the state transition diagrams-regarding the bowed stringed instruments, brass instruments and reed instruments.

An uppermost section of each state transition diagram shows a sequence for detection of outputs of the sensors and switches of the keyboard in which a performer operates (or depresses) one key. Herein, the electronic musical instrument (or abbreviated by "EMI") sequentially detects outputs of the sensors and switches in accordance with a sequence, as follows:

(i) Firstly, the EMI detects a touch (or touch-on event) of a finger on a key with the touch sensor 105;

(ii) Then, the EMI detects a start of a key stroke with the key-stroke sensor 108;

(iii) Then, the EMI detects ON of the 1M switch 106;

(iv) Then, the EMI detects On of the 2M switch 107;

(v) Then, the EMI detects outputs of the hammer-depression pressure sensor 110 and key-depression pressure sensor 109, wherein it is possible to detect outputs of left and right key-depression pressure sensors 109 independently;

(vi) Then, the EMI detects OFF of the 2M switch 107;

(vii) Then, the EMI detects OFF of the 1M switch 106;

(viii) Then, the EMI detects an end of the key stroke by the key-stroke sensor 108;

(ix) Lastly, the EMI detects a release (or touch-off event) of the finger that leaves from the key with the touch sensor 105.

An overall period of time that elapses between a timing to detect a touch-on event and a timing to detect a touch-off event is divided into five time sections, which are used for controlling five factors in generating musical tones, i.e., "position", "tone generation", "tone variation", "mute" and "smooth transition". That is, the electronic musical instrument (or EMI) performs controls with respect to the "position" for a certain acoustic instrument on the basis of outputs of sensors and switches during a first time section that elapses from the timing to detect the touch-on event to a timing to detect a start of a key stroke. Then, the EMI performs controls with respect to the "tone generation" (i.e., a manner to generate musical tones) of the acoustic instrument on the basis of outputs of sensors and switches during a second time section that elapses from the timing to detect the start of the key stroke to a timing to detect ON of the 2M switch 107. Then, the EMI performs controls with respect to the "tone variation" (i.e., a manner to apply variations to musical tones) of the acoustic instrument on the basis of outputs of sensors and switches during a third time section that elapses from the timing to detect ON of the 2M switch 107 to a timing to detect OFF of the 1M switch 106. Then, the EMI performs controls with respect to the "mute" (i.e., a manner to mute musical tones) of the acoustic instrument on the basis of outputs of sensors and switches during a fourth time section that elapses from the timing to detect OFF of the 1M switch to a timing to detect an end of the key stroke or the timing to detect the touch-off event. Finally, the EMI performs controls with respect to the "smooth transition" (i.e., a manner of smooth transition from one musical tone to another) of the acoustic instrument during a fifth time section that elapses from the timing to detect the end of the key stroke to the timing to detect the touch-off event.

Each state transition diagram shows blocks indicating performance techniques to be detected in connection with the sequence for detection of outputs of the sensors and switches of the keyboard in which the performer operates one key. Specifically, each block is partitioned into two sections, wherein an upper section indicates a performance technique (or performance techniques) being detected, and a lower section indicates musical information (e.g., pitch, tone volume, tone color) being controlled.

Blocks in FIG. 10 are designated by reference serial numerals (1) to (14), for which explanatory notes are described as follows:

(1) A performance technique of this block is detected if a key-on event occurs being slightly delayed from a key-touch event.

(2) A performance technique of this block is detected if a key-on event occurs speedily after a key-touch event.

(3) A performance technique of blocks is detected if a performer touches another key other than the key being presently operated.

(4) A performance technique of this block is detected if a performer does not touch another key other than the key being presently operated.

(5) Performance techniques of blocks are detected in response to switching made by a portamento foot switch.

(6) Performance techniques of this block is detected if an initial touch is made speedily, and pressure is relatively large.

(7) This block is concerned in cases other than the aforementioned case (8) Performance techniques of this block is detected if pressure is constantly and uniformly applied to the key.

(9) A performance technique of this block is detected if left and right pressures are varied speedily.

(10) A performance technique of this block is detected if pressure is varied speedily.

(11) A performance technique of this block is detected if pressure is gradually increased after being released.

(12) A performance technique of this block is detected if a return of the key being depressed is made slowly.

(13) A performance technique of this block is detected if the performer touches an adjacent key as well.

(14) A performance technique of this block is detected if depression of the key is not made sufficiently to reach pressure sensors.

Blocks of FIG. 11 are designated by reference serial numerals (1) to (18), for which explanatory notes are described as follows:

(1) Particularly, no distinction is made for detection of a performance technique of this block within blocks (1) to (3).

(2) Same as above.

(3) Same as above.

(4) A performance technique of this block is detected if a performer touches another key other than the key being presently operated.

(5) A performance technique of this block is detected if a performer does not touch another key.

(6) Performance techniques of blocks are detected in response to switching being made by a portamento foot switch.

(7) Performance techniques of this block are detected if an initial touch is made speedily, and pressure is relatively large.

(8) This block is concerned in other cases other than the aforementioned case (7).

(9) Performance techniques of this block are detected if pressure is constantly and uniformly applied to the key.

(10) A performance technique of this block is detected if left and right pressures are varied speedily.

(11) A performance technique of this block is detected if pressure is varied speedily.

(12) A performance technique of this block is detected if pressure is gradually increased after being released.

(13) It is necessary to make examination carefully.

(14) It is necessary to make examination carefully.

(15) A performance technique of this block is detected if a return of the key being depressed is made slowly.

(16) It is necessary to make examination carefully.

(17) A performance technique of this block is detected if a performer touches an adjacent key as well.

(18) A performance technique of this block is detected if depression of the key is not made sufficiently to reach pressure sensors.

Blocks of FIG. 12 are designated by reference serial numerals (1) to (19), for which explanatory notes are described as follows:

(1) Particularly, no distinction is made for detection of a performance technique of this block within blocks (1) to (3).

(2) Same as above.

(3) Same as above.

(4) A performance technique of this block is detected if a performer touches another key other than the key being presently operated.

(5) A performance technique of this block is detected if a performer does not touch another key.

(6) Performance techniques of blocks are detected in response to switching being made by a portamento foot switch.

(7) Performance technique of this block is detected if an initial touch is made speedily, and pressure is relatively large.

(8) This block is concerned in other cases other than the aforementioned case (7).

(9) Performance techniques of this block are detected if pressure is constantly and uniformly applied to the key.

(10) A performance technique of this block is detected if left and right pressures are varied speedily.

(11) A performance technique of this block is detected if pressure is varied speedily.

(12) A performance technique of this block is detected if pressure is gradually increased after being released.

(13) It is necessary to make examination carefully.

(14) It is necessary to make examination carefully.

(15) It is necessary to make examination carefully.

(16) It is necessary to make examination carefully.

(17) A performance technique of this block is detected if a return of the key is made slowly.

(18) A performance technique of this block is detected if a performer touches an adjacent key as well.

(19) A performance technique of this block is detected if depression of the key is not made sufficiently to reach pressure sensors.

The electronic keyboard instrument of the present embodiment is designed to branch off detection flows in the sequence for detection of performance techniques by switching of the foot switch before actually detecting the performance techniques in response to outputs of the sensors and switches accompanied with each of the keys of the keyboard. Namely, in FIGS. 10 to 13, a performer firstly operates a foot switch to switch over the sequences. If a slur foot switch is ON, the electronic keyboard instrument branches off the sequence thereof to a detection flow for detection of specific performance techniques such as slur and staccato. If a portamento foot switch is ON, the electronic keyboard instrument branches off the sequence thereof to a detection flow for detection of other performance techniques such as portamento and glissando. If both of the slur foot switch and portamento foot switch are OFF, the electronic keyboard instrument branches off the sequence thereof to a detection flow for detection of some performance techniques such as detache and spiccato.

Hereinafter, descriptions are made in detail with respect to various kinds of performance techniques being detected with reference to FIGS. 10 to 13. Particularly, the electronic keyboard instrument of this invention has four technical features as follows:

(a) The electronic keyboard instrument is equipped with multiple sensors and switches with respect to each of the keys. So, a specific performance technique is discriminated in response to outputs of the sensors and switches and is used to control musical tones.

(b) The acoustic instruments differ from each other in performance techniques being actually used. For detection of performance techniques in response to outputs of the sensors and switches, the electronic keyboard instrument uses different performance technique detection rules in detection of performance techniques by tone colors respectively.

(c) The electronic keyboard instrument detects a performance technique in response to outputs of the sensors and switches as described above. Thereafter, it determines the sensors and switches being actually used for actualization of the performance technique, so that musical tones are being controlled based on outputs of those sensors and switches. In addition, it stops using outputs of other sensors and switches.

(d) The electronic keyboard instrument is equipped with foot switches corresponding to manual operators, which are manually operable for a performer. So, the electronic keyboard instrument automatically determines a specific performance technique detection rule in response to an operation of the foot switch.

Next, descriptions are given in a concrete manner with respect to decisions for discrimination of performance techniques in connection with fourteen examples (1) to (14), wherein (1) to (5) are examples related to the aforementioned technical feature (a).

(1) Detache

A decision for "detache" will be described with reference to FIG. 10. Herein, detache is a performance technique concerned with a "position" of a bowed stringed instrument. The performance technique of detache is divided into three performance operations, as follows:

D1: Start playing an instrument from a condition where a bow is placed on a string.

D2: Play an instrument very smoothly with a smooth movement of a bow.

D3: Produce sounds by hitting strings with a bow.

The performance technique of detache is being detected based on a time that elapses from a timing to touch a key to a timing to start depression of the key or a time between a touch-on timing and a key-stroke start timing. Concretely speaking, the aforementioned performance operations D1 to D3 are being discriminated by comparing the time between the touch-on timing and key-stroke start timing with a prescribed value. That is, the electronic keyboard instrument discriminates the performance operation D1 if the time between the touch-on timing and key-stroke start timing is long. In addition, it discriminates the performance operation D2 if the time is intermediate. Further, it discriminates the performance operation D3 if the time is short.

Upon detection of the performance technique of detache, the electronic keyboard instrument controls an attack rate (AR) of musical tones as well as tone colors which may match with degrees of brightness and darkness in psychological reception. That is, the attack rate is made slow in response to D1. In addition, the attack rate is made intermediate in response to D2, while it is made fast in response to D3. Further, the tone color is being controlled as well. That is, the tone color is made "dark" in response to D1. In addition, the tone color is made "intermediate" in response to D2, while it is made "bright" in response to D3. Incidentally, it is possible to provide different waveforms with respect to the performance operations D1, D2 and D3 respectively. Or, it is possible to provide a specific parameter such as a frequency of a low-frequency oscillator (LFO), values of which differ from each other with respect to the performance operations D1, D2 and D3 respectively.

(2) Slur & Staccato

Decisions for performance techniques of slur and staccato will be described with reference to FIGS. 10 to 13. Herein, both of slur and staccato are performance techniques concerned with manners for generating tones in the bowed stringed instruments, brass instruments and reed instruments.

First, a description will be given with respect to a decision for slur. In the electronic keyboard instrument, the performance technique of slur is actualized or detected by a series of manual operations, as follows:

Firstly, a performer depresses a certain key to generate its musical tone. During a transition in key depression from the key being firstly depressed to a next key, the performer touches a surface of the next key in advance. Then, the performer releases the key being firstly depressed and depresses the next key. In accordance with the aforementioned operations, the electronic keyboard instrument determines that slur is being effected on the next key.

After discrimination of slur, the electronic keyboard instrument changes over modes of an envelope generator (EG), so that an initial level (IL) of the next key is started from a sustain level of the first key. In addition, smooth pitch transition is made from a pitch of a musical tone of the first key to a pitch of a musical tone of the next key.

Next, a description will be given with respect to a decision for staccato. The performance technique of staccato is actualized or detected by a series of manual operations, as follows:

First, a performer depresses a certain key to generate its musical tone. During a transition in key depression from the key being firstly depressed to a next key, the performer releases his or her finger off from a surface of the first key and starts depressing the next key. In accordance with the aforementioned operations, the electronic keyboard instrument determines that staccato is effected on the next key.

Upon discrimination of staccato, the electronic keyboard instrument changes attack rates for a tone volume EG and a tone color EG on the basis of a time that elapses from a timing to touch the touch sensor 105 to a timing to turn the 1M switch 106 ON. In addition, it changes release rates for the tone volume EG and tone color EG in response to an output of a key-off sensor. Incidentally, a time (corresponding to an initial touch) that elapses from the timing to turn the 1M switch 106 ON to a timing to turn the 2M switch 107 ON is used for controlling (or changing) the tone volume and tone color.

(3) Crescendo & Decrescendo

Decisions for crescendo and decrescendo will be described with reference to FIGS. 10 to 13. Herein, both of performance techniques of crescendo and decrescendo are concerned with manners for varying tones in the bowed stringed instruments, brass instruments and reed instruments.

First, a description will be given with respect to a decision for crescendo. The performance technique of crescendo is actualized or detected by a series of manual operations, as follows:

After completion of key depression, if pressure (i.e., pressure detected by the key-depression pressure sensor 109) being originally applied to the key is let off and is then increased again, the electronic keyboard instrument determines that crescendo is effected on the key. Upon discrimination of crescendo, the electronic keyboard instrument gradually increases a tone volume for the key. In addition, it also gradually increases harmonic components.

Next, a description will be given with respect to a decision for decrescendo. The performance technique of decrescendo is actualized or detected by a series of manual operations, as follows:

That is, if pressure (i.e., pressure detected by the key-depression pressure sensor 109) is slowly let off while a key-return stroke (which is detected by the key-stroke sensor 108) is slowly started, the electronic keyboard instrument determines that decrescendo is effected on the key. Upon discrimination of decrescendo, the electronic keyboard instrument gradually decreases a tone volume while gradually reducing harmonic a components in response to an amount of the key-return stroke. Incidentally, a key-off operation is made by a touch-off of a finger on the key.

(4) Portamento

A decision for portamento will be described with reference to FIGS. 10 to 13. The performance technique of portamento is concerned with manners for varying tones in the bowed stringed instruments, brass instruments and reed instruments. The performance technique of portamento is actualized or detected in accordance with a series of manual operations as follows:

Firstly, a performer depresses a certain key to generate its musical tone. During a transition in key depression from the key being firstly depressed to a next key, the performer slides his or her finger on a surface toward the next key having a desired pitch. In that case, the electronic keyboard instrument determines that portamento is effected on the next key.

Upon discrimination of portamento, the electronic keyboard instrument does not make a new key-on operation with respect to the next key. In addition, the electronic keyboard instrument controls pitches of musical tones to vary smoothly and continuously toward the desired pitch corresponding to the key in which the finger slides on the surface while sustaining a certain level and an envelope of the first key. Further, it smoothly changes a cut-off frequency of a filter (not shown). Incidentally, a key-off operation is made by a touch-off of the finger on the key.

(5) Vibrato & Tremolo

Decision for vibrato and tremolo will be described with reference to FIGS. 10 to 13. The performance techniques of vibrato and tremolo are concerned with manners of varying tones in the bowed stringed instruments, brass instruments and reed instruments.

First, a description will be given with respect to a decision for vibrato. The performance technique of vibrato is actualized or detected in accordance with manual operations, as follows:

During depression of a certain key, the performance technique of vibrato is detected if variations occur on outputs of the left/right key-depression pressure sensors 109, particularly if a performer moves his or her finger laterally in right/left directions on the key so that the left/right key-depression pressure sensors repeat increments and decrements alternately on outputs thereof by a velocity which is greater (or faster) than a predetermined value.

Upon discrimination of portamento, the electronic keyboard instrument continuously changes up and down a pitch of a musical tone corresponding to the depressed key on the basis of outputs of the left/right key-depression pressure sensors 109. In addition, the electronic keyboard instrument slightly changes a tone volume and a tone color based on the outputs of the left/right key-depression pressure sensors 109.

Next, a description will be given with respect to a decision for tremolo. The performance technique of tremolo is actualized or detected in accordance with manual operations, as follows:

During depression of a certain key, the performance technique of tremolo is detected if variations occur on an output of the key-depression pressure sensor 109, particularly if a performer moves his or her finger vertically in up/down directions on the key so that both of the left/right key-depression pressure sensors 109 repeat increments and decrements on outputs thereof in same phases by a velocity which is greater (or faster) than a predetermined value.

Upon discrimination of tremolo, the electronic keyboard instrument continuously changes up and down a tone volume of a musical tone corresponding to the depressed key on the basis of outputs of the key-depression pressure sensors 109. In addition, the electronic keyboard instrument slightly changes a tone color based on the outputs of the key-depression pressure sensors 109.

Next, descriptions will be given with respect to examples (6) to (8), which are related to the aforementioned technical feature (b).

(6) Detache

The decision for detache in FIG. 10 is described before in connection with the example (1). Herein, "detache" is a special performance technique, which is exclusively used in the bowed stringed instruments. So, when a tone color of a certain bowed stringed instrument is designated, "detache" is being detected by the aforementioned performance technique detection rule, the content of which is described before in connection with the example (1). That is, the electronic keyboard instrument detects the performance operations D1, D2 and D3 with regard to the performance technique of detache on the basis of the time that elapses from the timing to touch the key to the timing to start the key stroke.

When a tone color of a certain reed instrument is designated, the electronic keyboard instrument detects a performance technique of "tonguing" based on the time that elapses from the timing to touch the key to the timing to start the key stroke, which is shown in FIG. 12. Concretely speaking, a tonguing speed is detected based on the aforementioned time, so that using the tonguing speed, musical tones are controlled in attack rates (AR), tone colors and pitches.

As described above, the performance technique is adequately detected using the appropriate performance technique detection rule in response to the designated tone color (or acoustic instrument).

(7) Portamento & Glissando

Decisions for portamento and glissando will be described with respect to FIGS. 10 to 13, wherein the electronic keyboard instrument switches over detection between portamento and glissando in response to a tone color being designated. The performance technique of portamento has been already described in connection with the foregoing example (4). The performance technique of glissando is actualized or detected in accordance with manual operations, as follows:

First, a performer depresses a certain key to turn ON. During a transition in key depression from the key being firstly depressed to a next key, the performer slides his or her finger on a surface toward the next key having a desired pitch. Thus, it is possible to sequentially and smoothly change pitches toward the desired pitch of the key on which the performer's finger slides. Incidentally, a key-off operation is made by a touch-off of the finger on the key. In addition, initial-touch data are retained at a level of touch data of the key being firstly depressed.

The performance techniques of portamento and glissando are discriminated in response to tone colors. That is, if tone colors of certain acoustic instruments such as the violin, trumpet and guitar are designated, the electronic keyboard instrument discriminates the performance technique of portamento when the performer slides his or her finger on the surface of the key(s), so that pitches are being smoothly changed over. If tone colors of some acoustic instruments such as the piano and harpsichord are designated, the electronic keyboard instrument discriminates the performance technique of glissando when the performer slides his or her finger on the surface of the key(s), so that pitches are being sequentially changed over.

(8) Growl & Flutter Tonguing

Decisions for growl and flutter tonguing will be described with reference to FIGS. 11 and 12, wherein those two performance techniques should be detected in response to different tone colors respectively. Namely, if a tone color of some reed instrument such as the saxophone is designated, the electronic keyboard instrument discriminates the performance technique of growl when a performer depresses a key strongly so that an output of the key-depression pressure sensor 109 becomes greater than a predetermined value. In the case of the performance technique of growl being detected, the electronic keyboard instrument modulates a tone volume and pitch with a certain range of frequencies, which ranges between 50 Hz and 100 Hz, for example. Thus, the electronic keyboard instrument produces a musical tone of the reed instrument in a "voiced" tone color in which some human voice is produced simultaneously with blowing the reed instrument to produce its sound.

If a tone color of some brass instrument such as the trumpet is Ad designated, the electronic keyboard instrument discriminates the performance technique of flutter tonguing when an output of the key-depression pressure sensor 109 becomes greater than the predetermined value. In the case of the performance technique of flutter tonguing being detected, the electronic keyboard instrument modulates a tone volume and tone color with a certain range of frequencies, which ranges between 20 Hz and 50 Hz, for example.

Next, descriptions will be given with respect to examples (9) to (13), which are related to the aforementioned technical feature (c).

(9) Crescendo

The performance technique of crescendo has been already described in connection with the foregoing example (3). When detecting the performance technique, the electronic keyboard instrument performs prescribed controls such that tone volumes are being gradually increased, and harmonic components are being gradually increased. Those controls are made based on outputs of the key-depression pressure sensors 109. That is, after the performance technique of crescendo is detected, the electronic keyboard instrument exclusively uses the key-depression pressure sensors 109, so it does not refer to outputs of the key-stroke sensors 108 and hammer-depression pressure sensors 110.

(10) Decrescendo

The performance technique of decrescendo has been already described in connection with the foregoing example (3). When the performance technique of decrescendo is detected, the electronic keyboard instrument performs prescribed controls such that tone volumes are being gradually decreased, and harmonic components are being gradually reduced. Those controls are made based on outputs of the key-stroke sensors 108, which represent amounts of key-return strokes. That is, after the performance technique of decrescendo is detected, the electronic keyboard instrument exclusively uses the key-stroke sensors 108, so it does not refer to outputs of the key-depression pressure sensors 109 and hammer depression pressure sensors 110.

(11) Vibrato

The performance technique of vibrato has been already described in connection with the foregoing example (5). When the performance technique of vibrato is detected, the electronic keyboard instrument performs prescribed controls such that pitches are being changed up and down, while tone volumes and tone colors are being varied. Those controls are made based on outputs of the left/right key-depression pressure sensors 109. That is, after the performance technique of vibrato is detected, the electronic keyboard instrument exclusively uses the key-depression pressure sensors 109, so it does not refer to outputs of the key-stroke sensors 108 and hammer-depression pressure sensors 110.

(12) Tremolo

The performance technique of tremolo has been already described in connection with the foregoing example (5). When the performance technique of tremolo is detected, the electronic keyboard instrument performs prescribed controls such that tone volumes are being changed up and down, and tone colors are being varied. Those controls are made based on outputs of the key-depression pressure sensors 109. That is, after the performance technique of tremolo is detected, the electronic keyboard instrument exclusively uses the key-depression pressure sensors 109, so it does not refer to outputs of the key-stroke sensors 108 and hammer depression pressure sensors 110.

(13) Slur

The performance technique of slur has been already described in connection with the foregoing example (2). After the performance technique of slur is detected, the electronic keyboard instrument does not use a key-off velocity of a first key being operated, a key-off velocity of a next key being operated, and key strokes.

Lastly, a description will be given with respect to the example (14), which is related to the foregoing technical feature (d).

(14) Other Performance Techniques

As shown in FIGS. 10 to 13, when a performer depresses the slur foot switch by his or her foot, the electronic keyboard instrument makes decisions for discrimination of the performance techniques of slur and staccato, which have been already described in connection with the foregoing example (2). If the performer depresses the portamento foot switch by his or her foot, the electronic keyboard instrument makes decisions for discrimination of the performance techniques of portamento and glissando, which have been already described in connection with the foregoing examples (4) and (7). If both of the slur foot switch and portamento foot switch are not depressed, the electronic keyboard instrument performs decisions for discrimination of other performance techniques. As described above, the electronic keyboard instrument determines appropriate performance technique detection rules in response to operations of the foot switches.

Lastly, the present embodiment describes the electronic keyboard instrument as a hardware system or device installing certain programs. Of course, all functions of this invention are not necessarily limited to hardware structures, so some functions can be actualized by software processing. For example, some parts of the electronic keyboard instrument can be realized using a personal computer or else, in which they are displayed on a screen so that the user operates them with clicks of a mouse or else. In that case, programs actualizing the parts of the electronic keyboard instrument are provided by storage medium such as floppy disks, compact disks and the like, or they are provided and downloaded from some computer networks such as Internet. Specifically, the present embodiment can be redesigned to exclude the memories as the storage of information (e.g., musical performance data and programs), so that necessary information is provided by way of MIDI terminals from the Internet, for example.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. An electronic keyboard instrument comprising:

a keyboard having a plurality of keys, each of which are being operated by a performer;

a plurality of sensors for detecting performance operations accompanied with performance effected on the keyboard to output various kinds of performance information respectively;

a tone color selector for selecting a tone color corresponding to an acoustic instrument being simulated;

a sensor selector for selecting at least one of the plurality of sensors in response to the tone color being selected by the tone color selector; and a tone generator for generating musical tones in response to the performance effected on the keyboard, wherein the tone generator controls the musical tones on the basis of the performance information output from the at least one of the plurality of sensors being selected by the sensor selector with respect to at least one tone factor.

2. An electronic keyboard instrument according to claim 1 further comprising a performance technique detector for detecting a performance technique of an acoustic instrument being actualized based on the performance information output from the at least one of the sensors being selected by the sensor selector in response to the tone color, so that the tone generator controls the musical tones to simulate the performance technique detected by the performance technique detector.

3. An electronic keyboard instrument according to claim 1 wherein the tone factor corresponds to a tone volume, a pitch or a tone color.

4. An electronic keyboard instrument according to claim 1 wherein the performance operations accompanied with the performance on the keyboard correspond to touches of the keys of the keyboard.

5. An electronic keyboard instrument according to claim 1 wherein the performance operations accompanied with the performance on the keyboard correspond to speeds of depression of the keys of the keyboard.

6. An electronic keyboard instrument according to claim 1 wherein the performance operations accompanied with the performance on the keyboard correspond to depths of depression of the keys of the keyboard.

7. An electronic keyboard instrument according to claim 1 wherein the performance operations accompanied with the performance on the keyboard correspond to intensities of depression of the keys of the keyboard.

8. An electronic keyboard instrument comprising:

a keyboard having a plurality of keys, each of which is being operated by a performer;

a plurality of sensors for detecting performance operations accompanied with performance effected on the keyboard to output various kinds of performance information respectively;

a tone color selector for selecting a tone color corresponding to an acoustic instrument being simulated;

a performance technique detection ruler for determining a performance technique detection rule used for detection of performance techniques, which are suited to the tone color selected by the tone color selector;

a performance technique detector for detecting at least one of the plurality of performance techniques in response to the performance information output from the sensors in accordance with the performance technique detection rule, which is determined by the performance technique detection ruler; and a tone generator for generating musical tones in response to the performance effected on the keyboard, wherein the tone generator controls the musical tones to simulate the performance technique detected by the performance technique detector with respect to at least one tone factor.

9. An electronic keyboard instrument comprising:

a keyboard having a plurality of keys, each of which is being operated by a performer;

a plurality of sensors for detecting performance operations accompanied with performance effected on the keyboard to output various kinds of performance information respectively;

a performance technique detector for detecting at least one of a plurality of performance techniques in response to the performance information output from the sensors; and a tone generator for generating musical tones in response to the performance effected on the keyboard, wherein the tone generator selects at least one of the sensors within the plurality of sensors in accordance with the performance technique detected by the performance technique detector, so that the tone generator controls the musical tones based on the performance information output from the at least one of the sensors being selected with respect to at least one tone factor.

10. An electronic keyboard instrument comprising:

a keyboard having a plurality of keys, each of which is being operated by a performer;

a plurality of sensors for detecting performance operations accompanied with performance effected on the keyboard to output various kinds of performance information respectively;

at least one performance operator being operated by the performer;

a performance technique detection ruler for determining a performance technique detection rule for detection of performance techniques in response to an operation of the performance operator;

a performance technique detector for detecting a performance technique in response to the performance information output from at least one of the sensors in accordance with the performance technique detection rule, which is determined by the performance technique detection ruler; and a tone generator for generating musical tones in response to the performance effected on the keyboard, wherein the tone generator controls the musical tones to simulate the performance technique detected by the performance technique detector with respect to at least one tone factor.

11. An electronic keyboard instrument according to claim 10 wherein the performance operator corresponds to a foot switch, which is operated by the performer with a foot.

12. An electronic keyboard instrument comprising:

a keyboard having a plurality of keys, each of which is being operated by a performer;

a plurality of sensors for detecting performance operations accompanied with performance effected on the keyboard to output various kinds of performance information respectively;

a performance technique detector for detecting specific performance techniques on the basis of the various kinds of performance information being respectively and sequentially output from the plurality of sensors in a time-series manner so that the performance techniques being detected are adequately changed over a lapse of time; and a tone generator for generating musical tones in response to the performance effected on the keyboard, wherein the tone generator controls the musical tones to simulate each of the specific performance techniques being detected by the performance technique detector with respect to at least one tone factor.

13. An electronic keyboard instrument according to claim 12 further comprising a tone color selector for selecting a tone color corresponding to an acoustic instrument being simulated, wherein the performance technique detector changes over the performance techniques in response to the tone color selected by the tone color selector.

14. An electronic keyboard instrument according to claim 12 wherein the performance technique detector determines a next performance technique being detected next in response to a performance technique presently detected.

15. An electronic keyboard instrument according to any one of claims 8, 9, 10, and 12 wherein the tone factor corresponds to a tone volume, a tone color or a pitch.

16. An electronic keyboard instrument comprising:

a keyboard containing a plurality of keys, each of which is being operated by a performer;

a tone color selector for selecting a desired tone color corresponding to an acoustic instrument whose sounds are being simulated;

a plurality of sensors for detecting operations of the keys of the keyboard;

a plurality of foot switches, each of which is depressed by a foot of the performer to designate a specific performance technique detection rule in response to the tone color;

a performance technique detector for detecting a performance technique in accordance with the performance technique detection rule on the basis of outputs of the plurality of sensors; and a tone generator for generating musical tones with respect to the tone color, wherein the musical tones are controlled in response to the performance technique with respect to at least one tone factor.

17. An electronic keyboard instrument according to claim 16 wherein the tone factor corresponds to a tone volume, a tone color or a pitch.

18. An electronic keyboard instrument according to claim 16 wherein each of the keys of the keyboard is equipped with the plurality of sensors, which contain a touch sensor for detecting a touch of a finger of the performer on the key, a velocity sensor for detecting a velocity in key depression and key release of the key, a key-stroke sensor for detecting a key stroke of the key, two key-depression pressure sensors for respectively detecting left and right key-depression pressures being applied to the key, and a hammer-depression pressure sensor for detecting a hammer-depression pressure being applied to a hammer interlocked with the key.

19. An electronic keyboard instrument according to claim 18 wherein the velocity sensor consists of a first-make switch and a second-make switch, which are sequentially operated in response to key depression or key release of the key, so that an initial touch is detected by measuring a time that elapses from a timing to turn the first-make switch ON to a timing to turn the second-make switch ON.

20. An electronic keyboard instrument according to claim 18 wherein the performance technique detector detects special performance techniques such as tremolo and vibrato when rapid variations occur on the left and right key-depression pressures being applied to the key.

21. An electronic keyboard instrument according to claim 16 wherein the plurality of foot switches correspond to a damper pedal, a soft pedal and a sostenuto pedal as well as a slur foot switch and a portamento foot switch.

22. An electronic keyboard instrument according to claim 21 wherein operating the slur foot switch designate a slur-related performance technique detection rule for detection of prescribed performance techniques such as slur and staccato, while operating the portamento foot switch designate a portamento-related performance technique detection rule for detection of prescribed performance techniques such as portamento and glissando.

23. A musical tone control method for an electronic keyboard instrument comprising the steps of:

selecting a tone color of a simulated acoustic instrument on the electronic keyboard instrument;

selecting at least one of a plurality of sensors in response to the selected tone color, wherein the sensors detect performance operations accompanied with performance on the electronic keyboard instrument to produce performance information data; and generating musical tones in response to the performance operations on the electronic keyboard instrument, wherein generation of the musical tones is controlled by the performance information data output from the selected sensor.

24. A performance technique detection method for an electronic keyboard instrument comprising the steps of:

detecting performance operations accompanied with performance effected on a keyboard to output various kinds of performance informance, at least one of which is being selectively used;

determining a technique detection rule for detection of performance techniques in response to an operation of a performance operator;

detecting a performance technique in response to the performance information in accordance with the performance technique detection rule; and generating musical tones in response to the performance effected on the keyboard, wherein the musical tones are being controlled to simulate the performance technique with respect to at least one tone factor.

25. A performance technique detection method for an electronic keyboard instrument according to claim 24 further comprising the steps of:

selecting a tone color corresponding to an acoustic instrument being simulated; and wherein performance techniques are suited to the tone color being selected.

26. A musical tone generation method for an electronic keyboard instrument comprising the steps of:

determining a specific performance technique within a plurality of performance techniques on the basis of performance information data being output from a plurality of sensors which detect performance operations accompanied with performance on the electronic keyboard instrument;

determining a sensor to be used within the plurality of sensors on the basis of the specific performance technique; and generating musical tones in response to the performance operations on the electronic keyboard instrument, wherein generation of the musical tones is controlled by the performance information data being output from the used sensor.

27. A musical tone generation method according to claim 26 wherein the performance operations accompanied with the performance on the electronic keyboard instrument correspond to touches of the keys of a keyboard of the electronic keyboard instrument.

28. A musical tone generation method according to claim 26 wherein the performance operations accompanied with the performance on the electronic keyboard instrument correspond to speeds of the keys of a keyboard of the electronic keyboard instrument.

29. A musical tone generation method according to claim 26 wherein the performance operations accompanied with the performance on the electronic keyboard instrument correspond to depths of depression of the keys of a keyboard of the electronic keyboard instrument.

30. A musical tone generation according to claim 26 wherein the performance operations accompanied with the performance on the electronic keyboard instrument correspond to intensities of depression of the electronic keyboard instrument.

31. A performance technique detection method for an electronic keyboard instrument comprising the steps of:

detecting performance operations accompanied with performance effected on a keyboard to output various kinds of performance information, at least one of which is being selectively used;

detecting specific performance techniques on the basis of the various kinds of performance information respectively and sequentially in a time series manner so that the performance techniques being detected are adequately changed over a lapse of time; and generating musical tones in response to the performance effected on the keyboard, wherein the musical tones are being controlled to simulate each of the specific performance techniques with respect to at least one tone factor.

32. A performance technique detection method for an electronic keyboard instrument comprising the steps of:

selecting a desired tone color corresponding to an acoustic instrument whose sounds are being simulated;

detecting operations of keys of a keyboard;

designating a specific performance technique detection rule in response to the tone color;

detecting a performance technique in accordance with the performance technique detection rule on the basis of the operations of the keys of the keyboard; and generating musical tones with respect to the tone color, wherein the musical tones are being controlled in response to the performance technique with respect to at least one tone factor.

33. A machine-readable media for storing data and programs that cause an electronic keyboard instrument to execute a musical tone control method comprising the steps of:

detecting performance operations accompanied with performance effected on a keyboard to output various kinds of performance information respectively;

selecting a tone color corresponding to an acoustic instrument being simulated;

selecting at least one of the various kinds of performance information in response to the tone color being selected; and generating musical tones in response to the performance effected on the keyboard, wherein the musical tones are being controlled on the basis of the performance information with respect to at least one tone factor.

34. A machine-readable media storing data and programs that cause an electronic keyboard instrument to execute a performance technique detection method comprising the steps of:

detecting performance operations accompanied with performance effected on a keyboard to output various kinds of performance information respectively;

selecting a tone color corresponding to an acoustic instrument being simulated;

determining a performance technique detection rule used for detection of performance techniques, which are suited to the tone color being selected;

detecting at least one of the plurality of performance techniques in response to the performance information in accordance with the performance technique detection rule; and generating musical tones in response to the performance effected on the keyboard, wherein the musical tones are being controlled to simulate the detected performance technique with respect to at least one tone factor.

35. A machine-readable media storing data and programs that cause an electronic keyboard instrument to execute a performance technique detection method comprising the steps of:

detecting performance operations accompanied with performance effected on a keyboard to output various kinds of performance information, at least one of which is being selectively used;

detecting at least one of a plurality of performance techniques in response to the performance information; and generating musical tones in response to the performance effected on the keyboard, wherein the musical tones are being controlled based on the performance information with respect to at least one tone factor.

36. A machine-readable media storing data and programs that cause an electronic keyboard instrument to execute a performance technique detection method comprising the steps of:

detecting performance operations accompanied with performance effected on a keyboard to output various kinds of performance information, at least one of which is being selectively used;

determining a performance technique detection rule for detection of performance techniques in response to an operation of an performance operator;

detecting a performance technique in response to the performance information in accordance with the performance technique detection rule; and generating musical tones in response to the performance effected on the keyboard, wherein the musical tones are being controlled to simulate the performance technique with respect to at least one tone factor.

37. A machine-readable media storing data and programs that cause an electronic keyboard instrument to execute a performance technique detection method comprising the steps of:

detecting performance operations accompanied with performance effected on a keyboard to output various kinds of performance information, at least one of which is being selectively used;

detecting specific performance techniques on the basis of the various kinds of performance information respectively and sequentially in a time-series manner so that the performance techniques being detected are adequately changed over a lapse of time; and generating musical tones in response to the performance effected on the keyboard, wherein the musical tones are being controlled to simulate each of the specific performance techniques with respect to at least one tone factor.

38. A machine-readable media storing data and programs that cause an electronic keyboard instrument to execute a performance technique detection method comprising the steps of:

selecting a desired tone color corresponding to an acoustic instrument whose sounds are being simulated;

detecting operations of keys of a keyboard;

designating a specific performance technique detection rule in response to the tone color;

detecting a performance technique in accordance with the performance technique detection rule on the basis of the operations of the keys of the keyboard; and generating musical tones with respect to the tone color, wherein the musical tones are being controlled in response to the performance technique with respect to at least one tone factor.

* * * * *